US010144213B2

(12) United States Patent
Hashimoto et al.

(10) Patent No.: US 10,144,213 B2
(45) Date of Patent: Dec. 4, 2018

(54) PRINTING APPARATUS, RECORDING MEDIUM STORING PROGRAM, AND PRINTING METHOD

(71) Applicants: Kenichiroh Hashimoto, Kanagawa (JP); Masahiro Kido, Kanagawa (JP)

(72) Inventors: Kenichiroh Hashimoto, Kanagawa (JP); Masahiro Kido, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/617,160

(22) Filed: Jun. 8, 2017

(65) Prior Publication Data

US 2017/0355187 A1 Dec. 14, 2017

(30) Foreign Application Priority Data

Jun. 8, 2016 (JP) ..... 2016-114734
Apr. 17, 2017 (JP) ..... 2017-081023

(51) Int. Cl.
*B41J 2/01* (2006.01)
*B41J 2/045* (2006.01)

(52) U.S. Cl.
CPC ..... *B41J 2/04508* (2013.01); *B41J 2/04586* (2013.01)

(58) Field of Classification Search
CPC ..... B41J 2/2117; B41J 2/2114; B41J 11/0015; B41J 2/01; B41J 19/142; B41J 2/04505; B41J 2/04508; B41M 5/0017; G06K 15/105
See application file for complete search history.

(56) References Cited

U.S. PATENT DOCUMENTS 7,798,602 B2 * 9/2010 Kobayashi ..... B41J 2/2114 347/37
8,511,777 B2 * 8/2013 Tanoue ..... B41J 2/2117 347/14
8,851,609 B2 * 10/2014 Saita ..... B41J 11/002 347/100
9,767,394 B2 * 9/2017 Yoshikawa ..... B41J 2/2132
(Continued)

FOREIGN PATENT DOCUMENTS

JP 2007-050555 3/2007
JP 2012-206324 10/2012
JP 2013-230695 11/2013

*Primary Examiner* — Huan Tran
(74) *Attorney, Agent, or Firm* — Oblon, McClelland, Maier & Neustadt, L.L.P.

(57) ABSTRACT

A printing apparatus includes a liquid discharge device, a carriage, and a controller. The liquid discharge device includes a first nozzle row to discharge a first liquid to form an image and a second nozzle row to discharge a second liquid of a type different from the first liquid. The carriage is mounted with the liquid discharge device and reciprocally movable in a main scanning direction. The controller is configured to control the liquid discharge device to discharge the second liquid onto a region of a medium including another region onto which the first liquid is discharged. The controller includes a control unit to control the liquid discharge device to discharge the second liquid from the second nozzle row in both of forward movement and backward movement of the carriage and discharge the first liquid from the first nozzle row in one of the forward movement and the backward movement.

13 Claims, 13 Drawing Sheets

(56) References Cited

U.S. PATENT DOCUMENTS

| | | | | |
|---|---|---|---|---|
| 9,809,024 | B2 * | 11/2017 | Hashimoto | B41J 2/145 |
| 9,950,529 | B2 * | 4/2018 | Koide | B41J 2/145 |
| 2008/0309734 | A1 | 12/2008 | Nishimura et al. | |
| 2010/0020130 | A1 | 1/2010 | Hashimoto | |
| 2010/0053269 | A1 | 3/2010 | Fujii et al. | |
| 2010/0245490 | A1 | 9/2010 | Tsukamura et al. | |
| 2011/0141174 | A1 * | 6/2011 | Usuda | B41J 2/2114 347/12 |
| 2013/0147887 | A1 | 6/2013 | Kimura et al. | |
| 2013/0241990 | A1 | 9/2013 | Shimoda et al. | |
| 2014/0055527 | A1 | 2/2014 | Hashimoto | |
| 2016/0288496 | A1 * | 10/2016 | Koide | B41J 2/51 |
| 2016/0361919 | A1 | 12/2016 | Hashimoto | |

* cited by examiner

PRINTING APPARATUS, RECORDING MEDIUM STORING PROGRAM, AND PRINTING METHOD

CROSS-REFERENCE TO RELATED APPLICATIONS

This patent application is based on and claims priority pursuant to 35 U.S.C.§ 119(a) to Japanese Patent Application Nos. 2016-114734, filed on Jun. 8, 2016, and 2017-081023, filed on Apr. 17, 2017, in the Japan Patent Office, the entire disclosure of each of which is hereby incorporated by reference herein.

BACKGROUND

Technical Field

Aspects of the present disclosure relate to a printing apparatus, a recording medium storing a program, and a printing method.

Related Art

Examples of printing apparatuses include a printing apparatus that forms a process color image after printing a white background on a transparent medium, a printing apparatus that prints a white background after forming an image, and a printing apparatus that applies a treatment liquid, such as a pre-coating liquid or a post-coating liquid.

SUMMARY

In an aspect of the present disclosure, there is provided a printing apparatus that includes a liquid discharge device, a carriage, and a controller. The liquid discharge device includes a first nozzle row to discharge a first liquid to form an image and a second nozzle row to discharge a second liquid of a type different from the first liquid. The carriage is mounted with the liquid discharge device and reciprocally movable in a main scanning direction. The controller is configured to control the liquid discharge device to discharge the second liquid onto a region of a medium including another region onto which the first liquid is discharged. The controller includes a control unit to control the liquid discharge device to discharge the second liquid from the second nozzle row in both of forward movement and backward movement of the carriage and discharge the first liquid from the first nozzle row in one of the forward movement and the backward movement of the carriage.

In another aspect of the present disclosure, there is provided a non-transitory recording medium that stores a computer-readable program to cause a computer to perform a method of controlling an image forming apparatus. The method includes controlling a liquid discharge device of the image forming apparatus to discharge a second liquid onto a region of a medium including another region on which a first liquid is discharged; and controlling the liquid discharge device to discharge the second liquid from a second nozzle row of the liquid discharge device in both of forward movement and backward movement of a carriage of the image forming apparatus and discharge the first liquid from a first nozzle row of the liquid discharge device in one of the forward movement and the backward movement of the carriage.

In still another aspect of the present disclosure, there is provided a method of printing with a printing apparatus. The method includes controlling a liquid discharge device of the printing apparatus to discharge a second liquid onto a region of a medium including another region on which a first liquid is discharged; and controlling the liquid discharge device to discharge the second liquid from a second nozzle row of the liquid discharge device in both of forward movement and backward movement of a carriage of the printing apparatus and discharge the first liquid from a first nozzle row of the liquid discharge device in one of the forward movement and the backward movement of the carriage.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
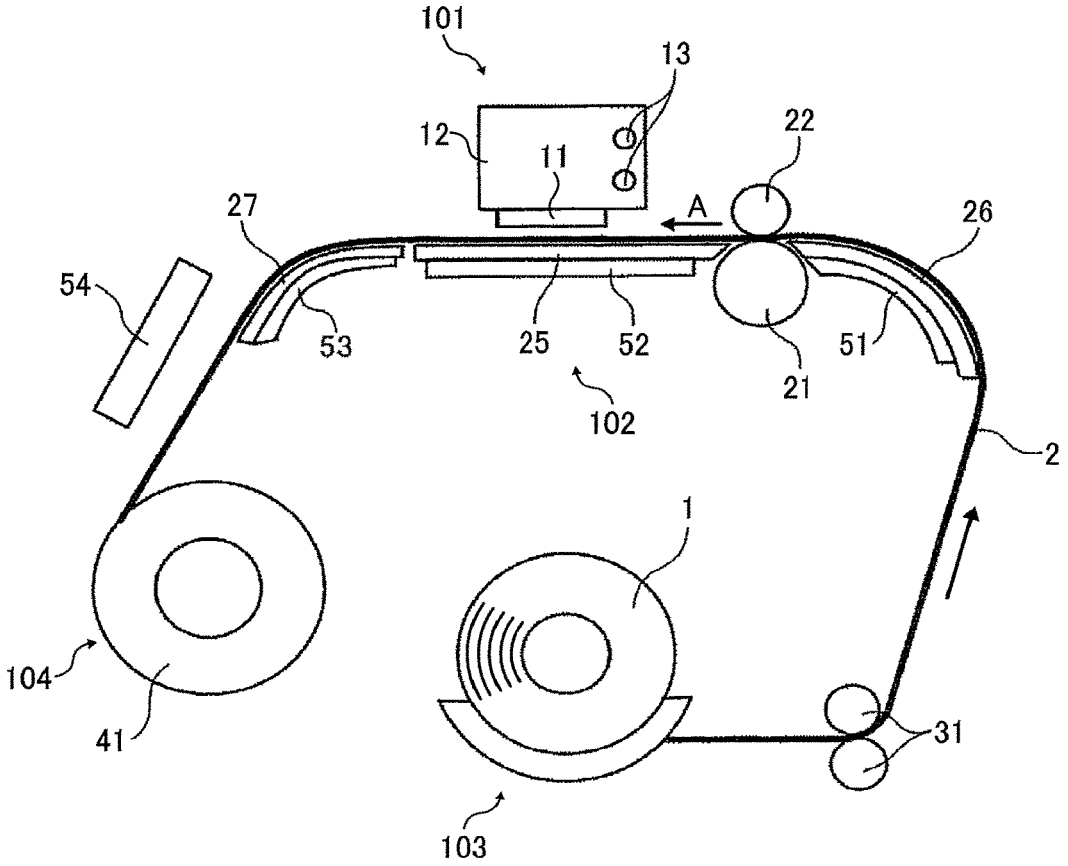
FIG. 1 is a side view of a printing apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Printing Apparatus and Printing Method

A printing apparatus according to an embodiment of the present disclosure includes a liquid discharge device, a carriage, and a controller. The liquid discharge device includes a first nozzle row to discharge a first liquid to form an image and a second nozzle row to discharge a second liquid of a type different from the first liquid. The carriage is mounted with the liquid discharge device and reciprocally movable in a main scanning direction. The controller controls the liquid discharge device to discharge the second liquid onto a region of a medium including another region onto which the first liquid is discharged. The controller includes a control unit to control the liquid discharge device to discharge the second liquid from the second nozzle row in both directions of a forward path and a backward path of the carriage and discharge the first liquid from the first nozzle row in one direction of the forward path and the backward path of the carriage. The controller further includes another unit as needed. For a printing method according to an embodiment of the present disclosure, ink containing water, a pigment, a siloxane compound, a compound of the following General Formula (1), and at least any resin of polycarbonate-based urethane resin and polyester-based urethane resin is used as the first liquid and the second liquid in a printing method using the printing apparatus according to an embodiment of the present disclosure. The printing method further includes another process, as needed.

Chemical Formula 1

GENERAL FORMULA (1)

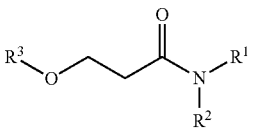

In the General Formula (1), each of $R^1$, $R^2$, and $R^3$ represents an alkyl group having carbon atoms of not less than 1 and not greater than 5. $R^1$, $R^2$, and $R^3$ may be identical to or different from each other. The inventors have found that, when unidirectional printing free of bidirectional color difference is performed to resolve bidirectional color difference in image formation, a printing apparatus might reduce the speed of applying a background liquid or treatment liquid onto a region other than an image formation region. Based on the above-described founding, the printing apparatus according to at least one embodiment of the present disclosure can enhance print qualities while reducing a decrease in print speed.

Figure 2:
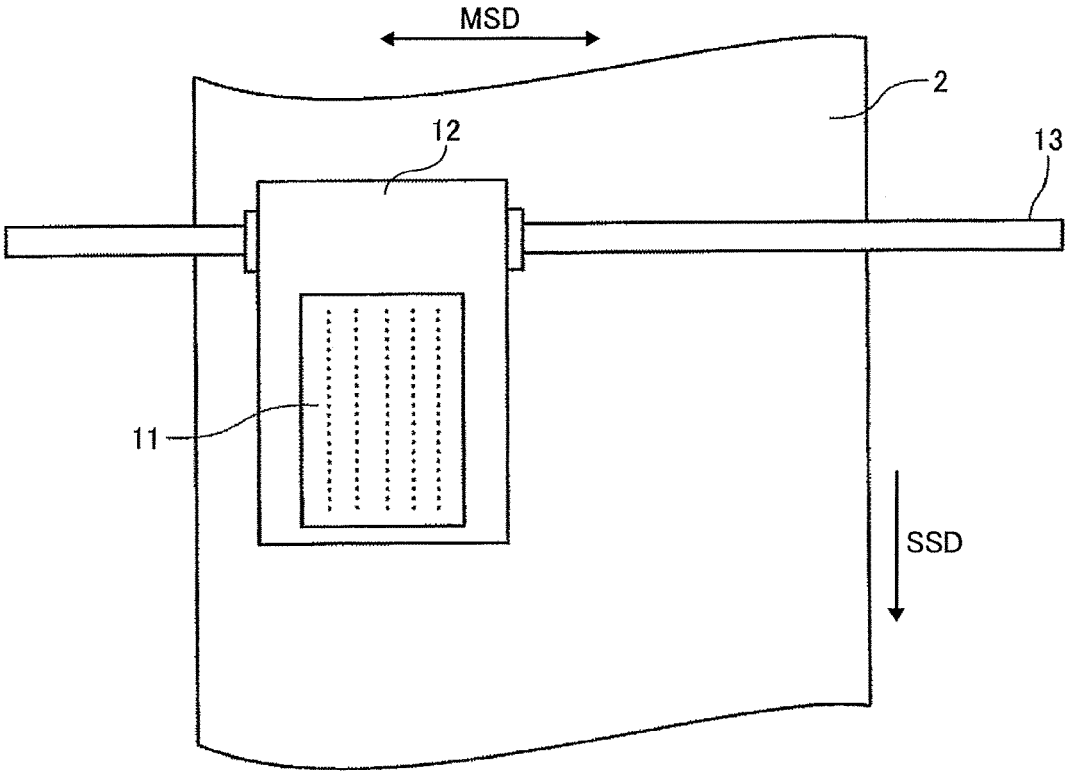
FIG. 2 is a plan view of a portion of the printing apparatus according to the first embodiment.
Figure 3:
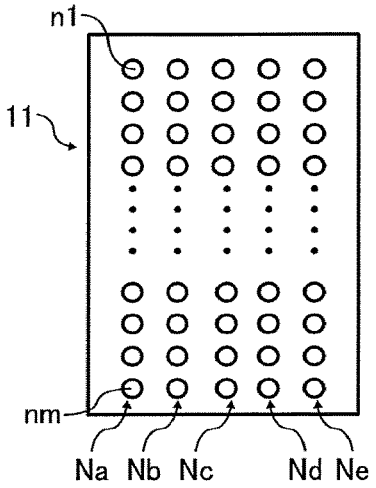
FIG. 3 is a plan view of a head of the printing apparatus according to the first embodiment.

A printing apparatus according to embodiments of the present disclosure is described below with reference to attached drawings. A printing method according to embodiments of the present disclosure is executed by the printing apparatus according to an embodiment of the present disclosure. First, a printing apparatus according to a first embodiment of the present disclosure is described with reference to FIGS. 1 to 3. FIG. 1 is a side view of the printing apparatus according to the first embodiment. FIG. 2 is a plan view of a portion of the printing apparatus according to the first embodiment. FIG. 3 is a plan view of a liquid discharge head of the printing apparatus.

The printing apparatus is a serial-type inkjet recording apparatus, and includes a printing unit (image forming unit) 101 configured to perform printing on a medium 2, a conveyance device 102 configured to convey the medium 2, a roll mount 103 configured to mount the medium 2, a roll winder 104 configured to wind up the medium 2, and so forth.

In the printing apparatus, a rolled medium 1 formed by winding the medium 2 into a roll shape is used. The rolled medium 1 is mounted by the roll mount 103, and paired conveyance rollers 31 draw out and send out the medium 2 from the rolled medium 1.

The printing unit 101 includes a liquid discharge head (hereinafter referred to as a "head") 11 mounted on a carriage 12. The head 11 serves as a liquid discharger and includes a plurality of nozzle rows configured to discharge liquid. The carriage 12 is supported by guide members 13 so as to be reciprocally movable in a main scanning direction indicated by arrow MSD in FIG. 2 (a direction vertical to a sheet face on which FIG. 1 is printed).

As illustrated in FIG. 3, the head 11 includes a plurality of nozzle rows Na to Ne each including a plurality of nozzles n1 to nm arranged in line, and is mounted on the carriage 12. The nozzles n1 to nm discharge liquid. The number of nozzles n1 to nm in each nozzle row is m, and the nozzle array direction of the nozzles n1 to nm in each nozzle row is set to a medium conveyance direction indicated by arrow A in FIG. 1 (a sub-scanning direction indicated by arrow SSD in FIG. 2).

The nozzle row Na of the head 11 includes, for example, a second nozzle row used for discharging a liquid of a background color, such as white (W), serving as a second liquid. The nozzle rows Nb to Ne of the head 11 include, for example, first nozzle rows used for discharging liquids of process colors for image formation, such as black (K), yellow (Y), magenta (M), and cyan (C), serving as first liquids. Although one head includes the five nozzle rows Na to Ne in the present embodiment, a configuration in which a plurality of nozzle rows are distributed to a plurality of heads may be alternatively employed.

The adhesion amount of the first liquid and the second liquid to a recording medium is, preferably, in a range of not less than 1.5 g/cm$^2$ and not greater than 15 g/cm$^2$ in consideration of print qualities.

The conveyance device 102 includes a conveyance roller 21 and a counter roller 22 disposed upstream of the printing unit 101 in the medium conveyance direction indicated by arrow A in FIG. 1 (the sub-scanning direction indicated by arrow SSD in FIG. 2). The conveyance roller 21 and the counter roller 22 serve as a conveyor, and nip and convey the medium 2. A platen member 25 to guide the medium 2 is disposed so as to oppose the printing unit 101.

The roll winder 104 includes a winding roll 41 to wind up the medium 2.

A pre-heater 51, a print heater 52, and a post-heater 53 are disposed along the conveyance direction of the medium 2. A conveyance guide 26 and a conveyance guide 27 are also disposed along the conveyance direction of the medium 2.

The pre-heater 51 is a heater to heat the medium 2 in a region before a print region in which printing is performed by the printing unit 101. The print heater 52 is a heater to heat the medium 2 in the print region in which printing is performed by the printing unit 101. The post-heater 53 is a heater to heat the medium 2 after printing is performed by the printing unit 101. For example, electric heaters utilizing ceramics or Nichrome wires may be used as the pre-heater 51, the print heater 52, and the post-heater 53.

A warm-air fan 54 to blow warm air onto the medium 2 is provided downstream of the post-heater 53. The warm-air fan 54 directly blows warm air onto liquid on a print surface, and thus the humidity in the atmosphere is reduced and the liquid on the print surface is completely dried up.

As a result of the heaters 51 to 53 and the warm-air fan 54 being provided, printing can be performed on a liquid-impermeable medium, such as a medium formed of vinyl chloride, polyethylene terephthalate (PET), or acrylic resin. On the liquid-impermeable medium, a good fixing performance can be achieved by using a solvent-based liquid, an aqueous resin liquid of a high resin content, or the like.

The heating temperature of each heater is adjustable according to the type or amount of organic solvent contained in the first liquid and the second liquid, the minimum film-forming temperature of added resin particles, and the type of print medium to be printed.

The heating temperature is preferably high from the point of view of drying performance and film-forming temperature. For example, the heating temperature is preferably not lower than 40° C. and not higher than 120° C., more preferably not lower than 40° C. and not higher than 100° C., still more preferably not lower than 50° C. and not higher than 90° C.

Figure 4:
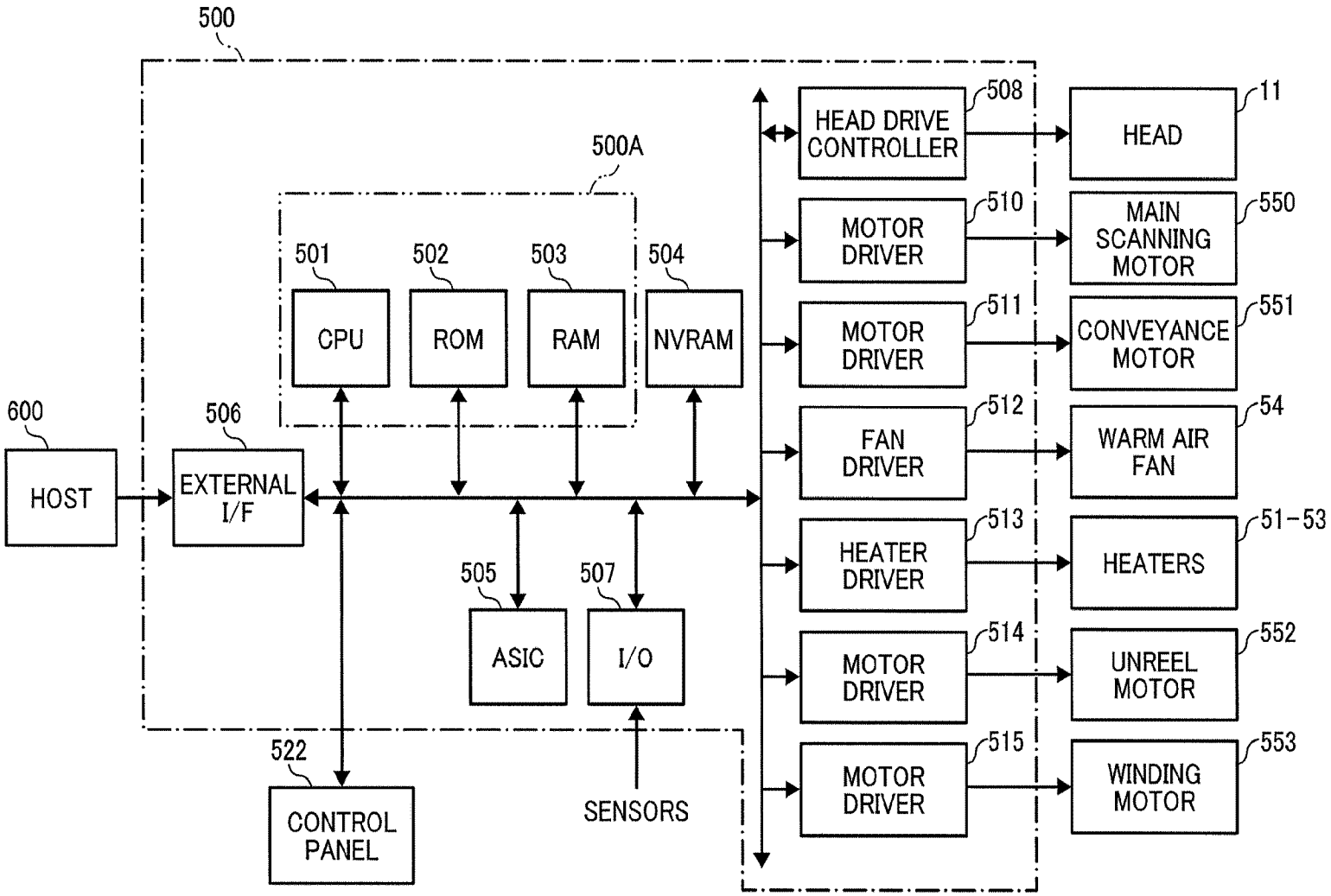
FIG. 4 is a block diagram of a controller of the printing apparatus according to the first embodiment.

Next, the summary of a controller of the printing apparatus is described with reference to an explanatory block diagram of FIG. 4.

A controller 500 includes a main controller 500A. The main controller 500A includes a central processing unit (CPU) 501, a read only memory (ROM) 502, and a random access memory (RAM) 503. The CPU 501 controls the entire printing apparatus. The ROM 502 stores programs and other fixed data. The programs include a program according to an embodiment of the present disclosure for causing the CPU 501 to perform control including control according to an embodiment of the present disclosure. The RAM 503 temporarily stores print data and so forth.

The controller 500 includes a nonvolatile RAM (NVRAM) 504 for holding data while the power of the printing apparatus is off. In addition, the controller 500 includes an application specific integrated circuit (ASIC) 505 configured to perform image processing, in which various signals related to image data is processed, and process other input/output signals for performing overall control of the printing apparatus.

The controller 500 includes an interface (I/F) 506 for transmitting and receiving data and signals used in receiving print data from an external host device 600.

The controller 500 includes an input-and-output (I/O) 507 for receiving detection signals from various sensors.

The controller 500 includes a head drive controller 508 configured to control the driving of the head 11.

The controller 500 includes motor drivers 510 and 511. The motor driver 510 is configured to drive a main scanning motor 550 that moves the carriage 12 in the main scanning direction (indicated by arrow MSD in FIG. 2), and the motor driver 511 is configured to drive a conveyance motor 551 that rotates the conveyance roller 21.

The controller 500 includes a fan driver 512 and a heater driver 513. The fan driver 512 is configured to drive the warm-air fan 54, and the heater driver 513 is configured to drive the heaters 51 to 53.

The controller 500 includes motor drivers 514 and 515. The motor driver 514 is configured to drive an unreel motor 552 that sends out the medium 2 from the rolled medium 1 of the roll mount 103, and the motor driver 515 is configured to drive a winding motor 553 that winds up the medium 2 around the winding roll 41 of the roll winder 104.

The controller 500 is coupled to a control panel 522 for inputting and displaying information necessary for the printing apparatus.

Figure 5:
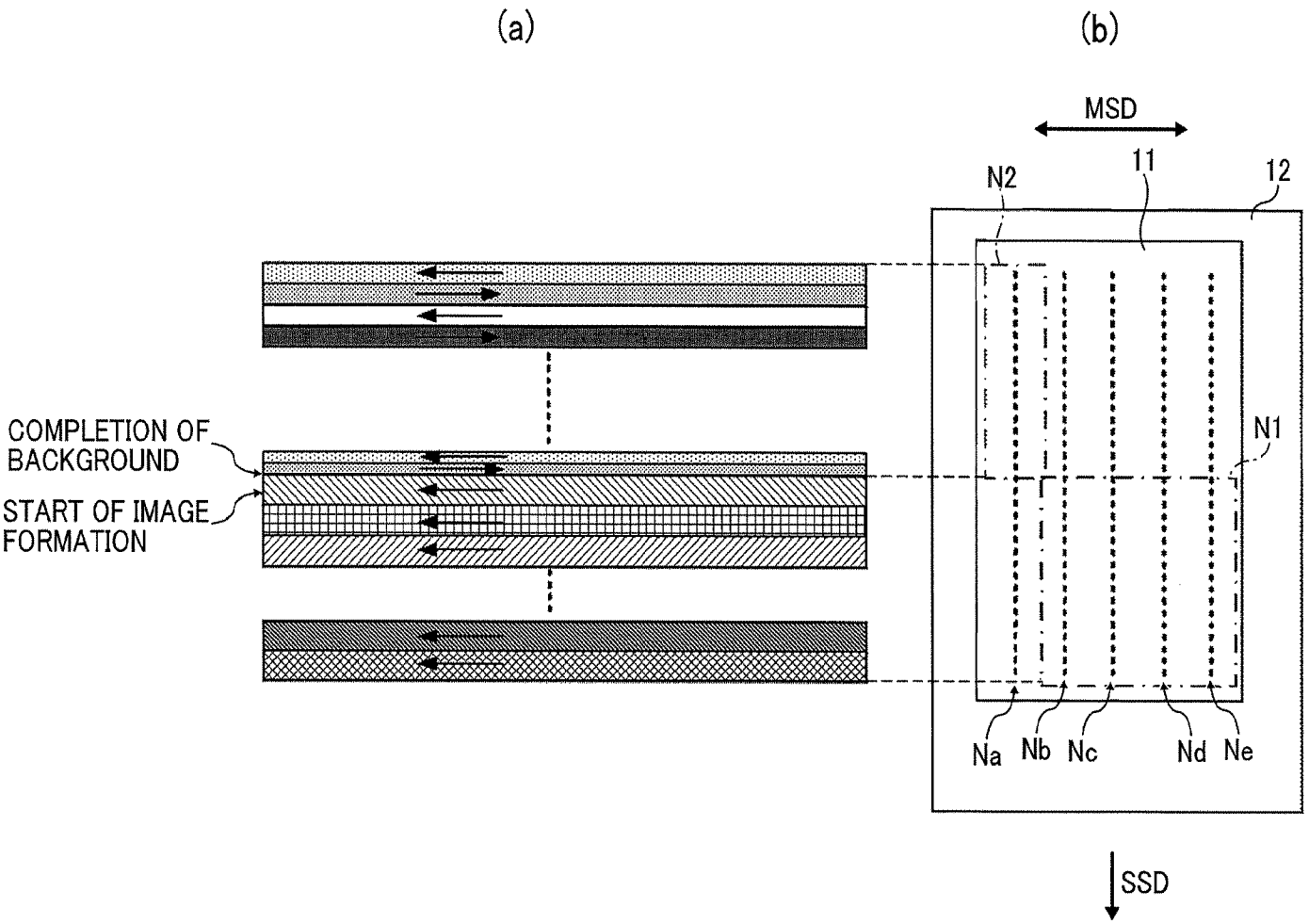
FIG. 5 is a plan view of a head and a printing process on a medium according to an embodiment of the present disclosure.

Next, a first embodiment of the present disclosure is described with reference to FIG. 5. FIG. 5 is a plan view of the first embodiment. Part (a) of FIG. 5 is a plan view of a printing sequence on the medium 2. Part (b) of FIG. 5 is a plan view of the head 11.

Here, the nozzle rows Na to Ne each include, for example, 192 nozzles n (m=192).

In the present embodiment, a part corresponding to nozzles n1 to n96, which are nozzles located on the upstream side in the sub-scanning direction SSD among nozzles n1 to n192 making up the nozzle row Na, of the nozzle row Na is used as a second nozzle row N2 that discharges a background ink (for example, white ink), which is a liquid of a background color, serving as the second liquid. That is, the head 11 includes the nozzle row Na including a plurality of nozzles, at least a part of which is used as the second nozzle row N2 to discharge the second liquid different from the first liquids.

Meanwhile, parts corresponding to nozzles n97 to n192, which are nozzles located on the downstream side in the sub-scanning direction SSD among nozzles n1 to n192 making up the nozzle rows Nb to Ne, of the nozzle rows Nb to Ne are used as first nozzle rows N1 that discharge liquids for image formation (for example, YMCK inks) serving as the first liquids.

When the second liquid is used, nozzles not included in the second nozzle row N2 or the first nozzle rows N1 are not used. When the second liquid is not used, all nozzles included in the nozzle rows Nb to Ne are used for discharging liquids for image formation.

Next, control for printing of background color and printing of an image in the present embodiment is described.

Here, the white ink is discharged onto the medium 2 to print the background of white ink in both of forward movement and backward movement of the carriage 12 by using the second nozzle row N2. A background area onto which the white ink is discharged is a region including the whole of a region in which an image is printed. That is, so-called solid printing is performed.

Then, the liquids for image formation are discharged onto the region having a completed background to form an image in either one of the forward movement and the backward movement of the carriage 12 by using the first nozzle rows N1.

In this way, bidirectional printing is performed for the background, and the image is formed via unidirectional printing.

In the case where bidirectional printing is performed, color border bleeding or bidirectional color difference occurs and the print quality is degraded. In the case where unidirectional printing is performed, the print speed is lowered. To address this, bidirectional printing is used for the background color, which is monochromatic, to suppress the lowering of the print speed, and unidirectional printing is used for the image to improve the print quality.

Figure 6:
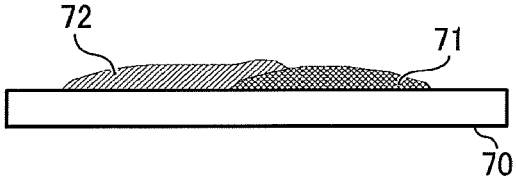
FIG. 6 is a side view of a state of ink used in the printing apparatus and a printing method according to an embodiment of the present disclosure.
Figure 7:
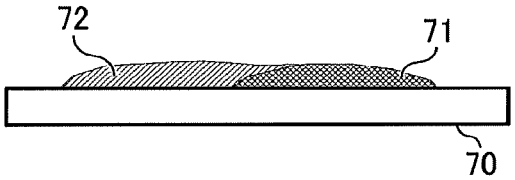
FIG. 7 is a side view of another state of the ink of FIG. 6.
Figure 8:
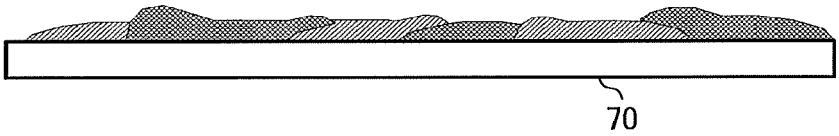
FIG. 8 is a side view of still another state of the ink of FIG. 6.
Figure 9:
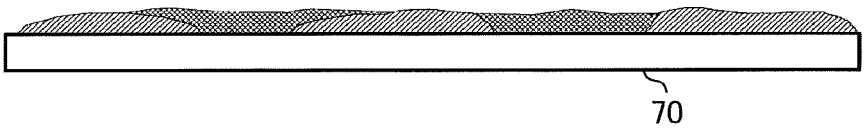
FIG. 9 is a side view of still yet another state of the ink of FIG. 6.

Here, the mechanism of enhancing the print quality is further described with reference to FIGS. 6 to 9. In FIGS. 6 to 9, ink 71 and ink 72 landed on a recording medium 70 are illustrated. As illustrated in FIG. 6, when adjacent ink 72 is landed after ink 71 precedently landed the recording medium 70 is dried to some extent, ink 71 is in a thickened state of high viscosity or a semi-cured state. Even when the ink 72 is landed near the ink 71, ink droplets of the ink 71 and the ink 72 do not mix with each other. When ink droplets do not mix with each other, the shape of ink droplets remain. As a result, as illustrated in FIG. 8, an irregular surface is formed on the ink layer. By contrast, as illustrated in FIG. 7, when the adjacent ink 72 is landed before the ink 71 precedently landed is dried, ink droplets of the ink 71 and the ink 72 mix with each other. When the ink droplets mix with each other, as illustrated in FIG. 7, the shape of ink droplets do not remain. As illustrated in FIG. 9, a smooth surface of the ink layer is formed, thus allowing enhancement of glossiness. As the drying performance of ink is higher, the smoothness (glossiness) is likely to be lower. However, in the present embodiment, since the second liquid is discharged by bidirectional printing, a reduction in the smoothness can be suppressed even if ink having high drying performance is used.

Accordingly, the print quality can be improved while suppressing the lowering of the print speed even in the case where the background is printed.

In addition, by printing the background via bidirectional printing, the adhesion amount of white ink can be increased compared with the case where the background is printed via unidirectional printing. For example, in the case of performing ¼ interlaced printing, the image is printed via sixteen unidirectional scans, and the background is printed via thirty-two bidirectional scans.

In this way, as a result of the adhesion amount of the white ink being increased, a higher density is achieved and thus, for example, a covering property of the background is improved.

In the case where a white solid background is formed with white ink on a transparent medium and is illuminated by a backlight or the like, if the density of the white solid background is low, the covering property of the white background would be lower, thus resulting in a problem that the shape of the backlight is seen through the background.

To address this, the density of the white solid background can be increased and thus the covering property of the white background can be improved by discharging the white ink in a bidirectional manner to increase the adhesion amount of white ink as in the present embodiment.

Moreover, since the background is printed by discharging white ink in movements in both directions, the same print speed as a case where the background is printed only in movement in one direction can be achieved with fewer nozzles in the case of printing a background of the same density. According to this, the size of the carriage 12 can be reduced.

Figure 10:
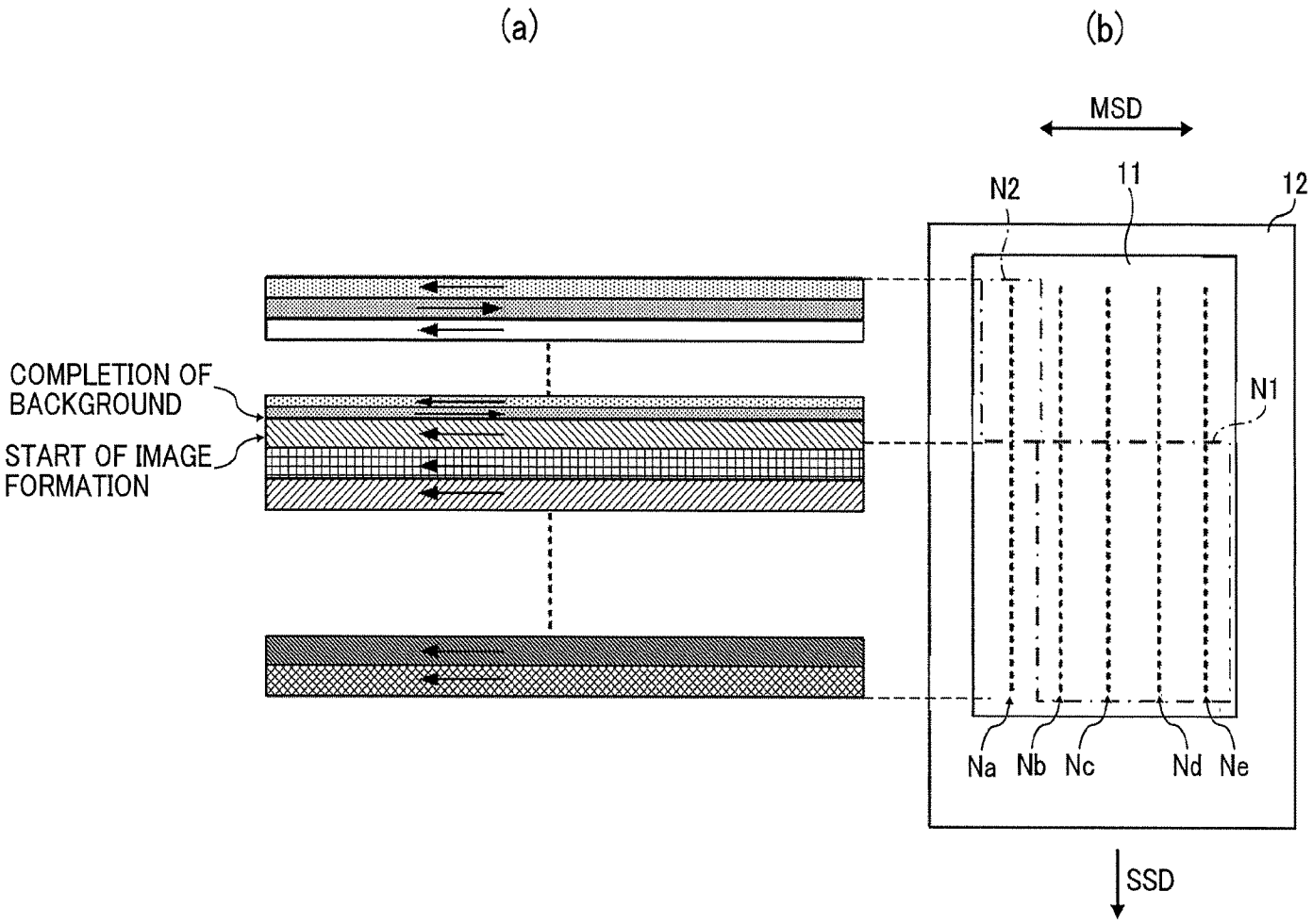
FIG. 10 is a plan view of a second embodiment of the present disclosure.

Next, a second embodiment of the present disclosure is described with reference to FIG. 10. FIG. 10 is a plan view of the second embodiment. Part (a) of FIG. 10 is a plan view of a printing sequence on the medium 2. Part (b) of FIG. 10 is a plan view of the head 11.

The nozzle rows Na to Ne of the head 11 all have the same length (the same number of nozzles). Therefore, in the case where the first nozzle rows N1 and the second nozzle row N2 are displaced from each other in the sub-scanning direction to positions not overlapping in the main scanning direction, the number of nozzles used as the second nozzle row N2 becomes smaller as the number of nozzles used as the first nozzle rows N1 becomes larger.

In the present embodiment, the number of nozzles used as each of the first nozzle rows N1 is larger than the number of nozzles used as the second nozzle row N2.

According to this, the number of nozzles used as the first nozzle rows N1 is larger than in the first embodiment, and thus the image formation speed can be improved.

In this case, by setting the length (the number of nozzles) of the second nozzle row N2 to be a half of the length (the number of nozzles) of each of the first nozzle rows N1, the print speed can be increased to be 1.5 times as fast as in the first embodiment. That is, lowering of the print speed caused in unidirectional printing can be suppressed.

In contrast, since the background is printed via bidirectional printing, the background can be printed by an ink attached in the same adhesion amount as the inks for image formation, and thus lowering of the covering property of the background occurring in the case where the number of used nozzles is reduced can be suppressed. In this case, a better covering property of the background can be ensured by using a background liquid as a second liquid having a high density.

Figure 11:
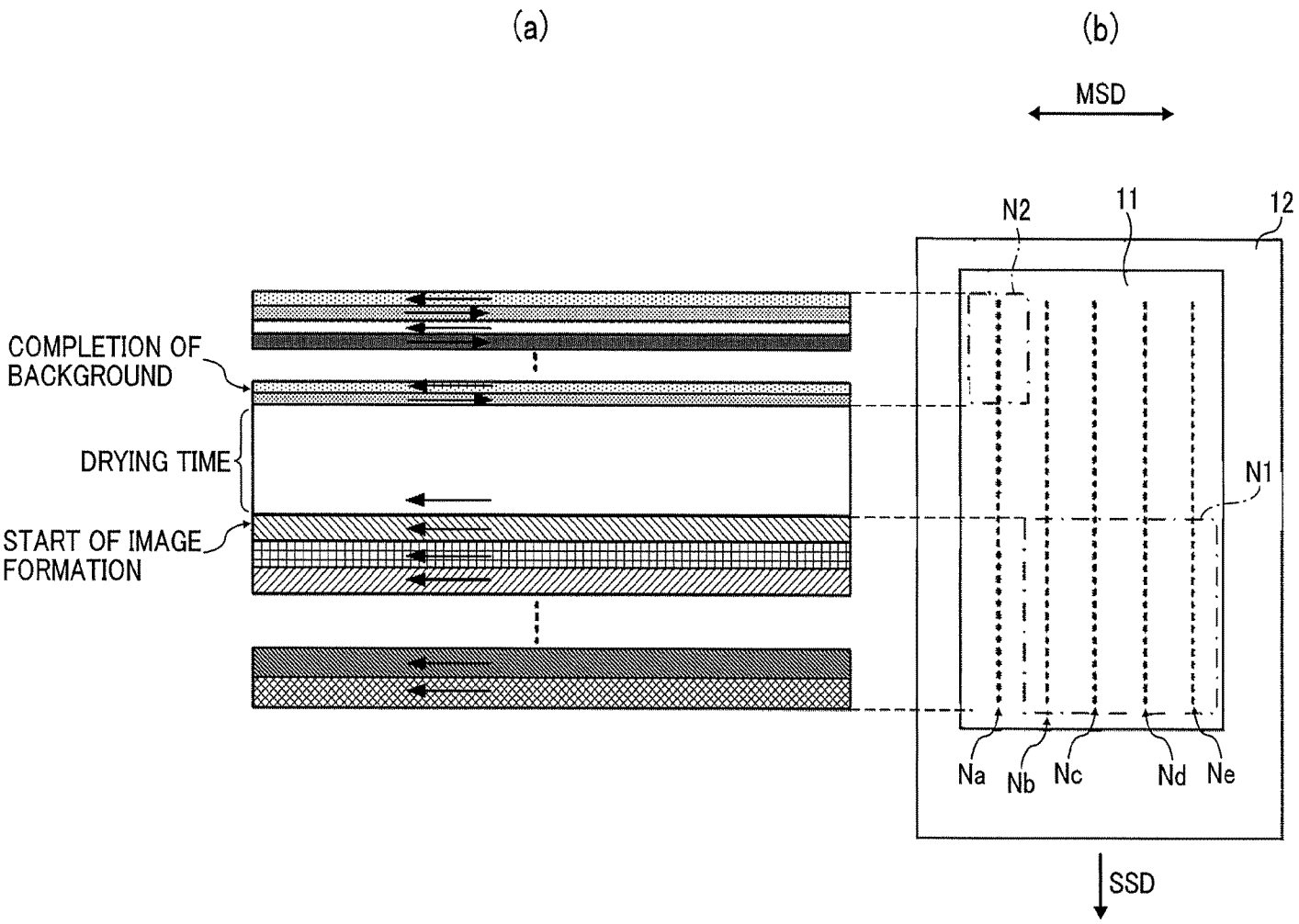
FIG. 11 is a plan view of a third embodiment of the present disclosure.

Next, a third embodiment of the present disclosure is described with reference to FIG. 11. FIG. 11 is a plan view of the third embodiment. Part (a) of FIG. 11 is a plan view of a printing sequence on the medium 2. Part (b) of FIG. 11 is a plan view of the head 11.

In the present embodiment, the second nozzle row N2 and the first nozzle rows N1 are distributed so as to be away from each other in the sub-scanning direction SSD. For example, nozzles n of the nozzle row Na included in a range from the most upstream nozzle in the sub-scanning direction SSD to a nozzle located in a distance equal to a quarter of the length of the nozzle row Na from the most upstream nozzle are assigned to the second nozzle row N2, and nozzles n of the nozzle rows Nb to Ne included in a range from the most upstream nozzles in the sub-scanning direction to nozzles located in a distance equal to a half of the length of the nozzle rows Nb to Ne from the most upstream nozzles are assigned to the first nozzle rows N1. In this case, there is a gap of unused nozzles having a width corresponding to a quarter of the length of the nozzle rows Na to Ne between the second nozzle row N2 and the first nozzle rows N1.

According to this, a temporal interval is provided between the time at which unidirectional printing of the background is completed by the second nozzle row N2 and the time at which image formation is started by the first nozzle rows N1. This temporal interval is used as time for drying the background ink.

That is, in the case where, for example, image forming inks (inks for image formation) are discharged onto a white solid background not sufficiently dried up, the image forming inks discharged onto the white solid background may sink in the white ink or bleeding may occur. These problems can be solved by providing the time for drying.

Although the gap of unused nozzles having the width corresponding to a quarter of the length of the nozzle rows Na to Ne is present between the second nozzle row N2 and the first nozzle rows N1 in the present embodiment, the time for drying can be elongated by increasing the width of the gap of unused nozzles to a value corresponding to a third of the length of the nozzle rows Na to Ne.

In the unidirectional printing, when white ink is discharged to print a background, white ink is not discharged in the backward path, thus allowing the time of movement on the backward path to be used as the drying time. By contrast, in bidirectional printing, white ink is discharged on the backward path. Therefore, white ink may not be sufficiently dried up unless the drying time is increased compared with the unidirectional printing. As a result, image forming ink may sing into color ink or bleeding may occur.

The method of increasing the drying time is, for example, a method of setting the length (number) of unused nozzles in bidirectional printing to be greater than the length (number) of unused nozzles in unidirectional printing. More specifically, for example, there is a method of increasing the drying time by interposing unused nozzles corresponding a quarter or one-third of the length of the nozzle row in bidirectional printing, even if it is sufficient to interpose unused nozzles corresponding to one-fifth of the length of the nozzle row in unidirectional printing.

For multi-scan, there are a plurality of backward paths and the drying time occurs according to the number of times of scanning in the drying time in unidirectional printing and bidirectional printing. For example, when the difference in drying time between unidirectional printing and bidirectional printing in single scan is calculated by the length of unused nozzles, the difference is a time corresponding to one twentieth of the length of the nozzle row obtained by subtracting a length (one fifth) corresponding to unused nozzles in single printing from a length (a quarter) corresponding to unused nozzles in bidirectional printing. For multi-scan in which the number of times of scanning is n (n=2 or greater), unused nozzles corresponding to n-times of the length corresponding to one twentieth in single scan (n=1) are needed for multi-scan. In the case of n=2, unused nozzles corresponding to seven twentieth of the length of the nozzle row, which is obtained by adding the length of nozzles corresponding to one tenth (twice of one twentieth of the length of the nozzle row) to the length (a quarter) of unused nozzles in bidirectional printing of single scan, are set to prevent insufficient drying of white ink.

Figure 12:
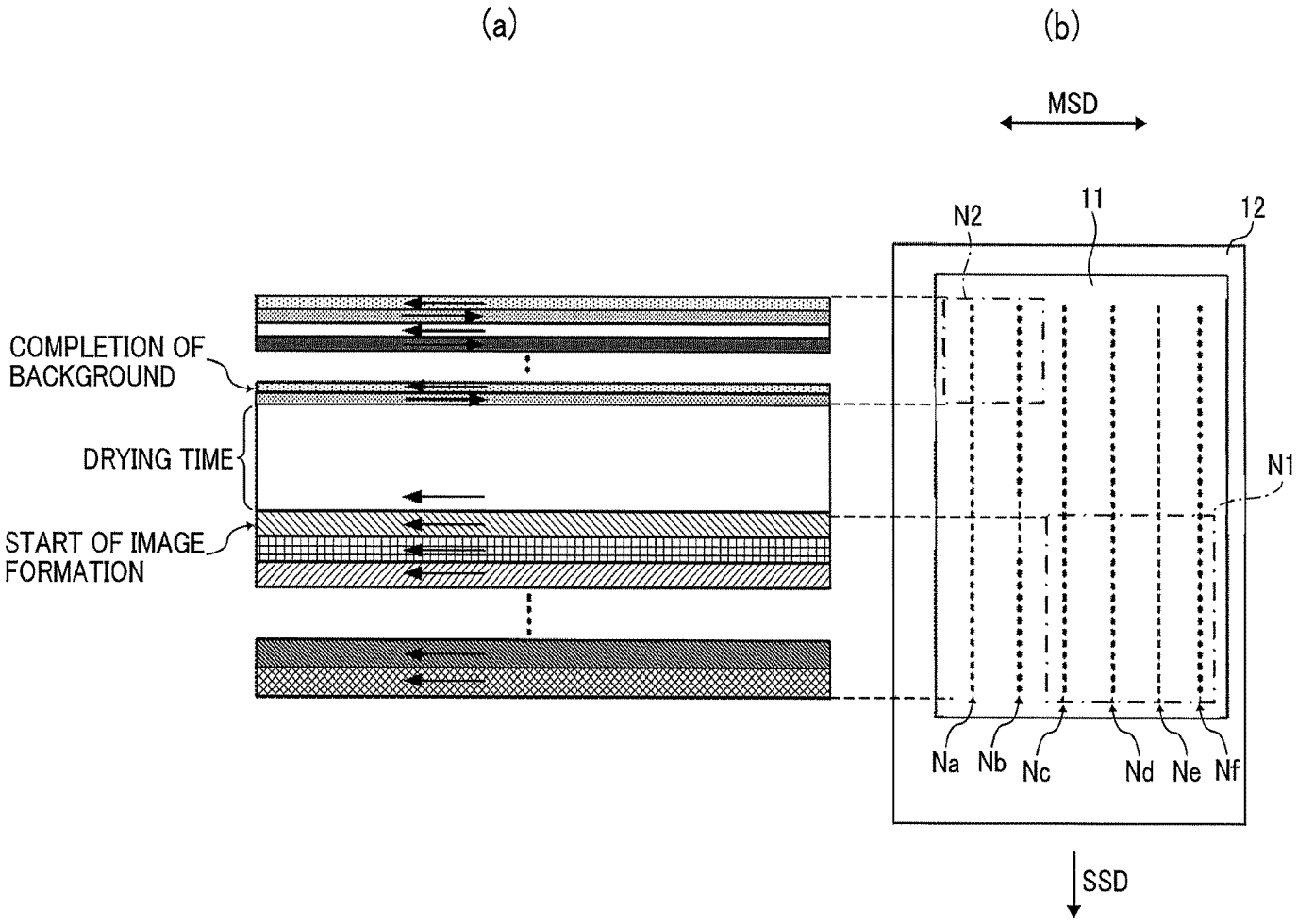
FIG. 12 is a plan view of a fourth embodiment of the present disclosure.

Next, a fourth embodiment of the present disclosure is described with reference to FIG. 12. FIG. 12 is a plan view of the fourth embodiment. Part (a) of FIG. 12 is a plan view of a printing sequence on the medium 2. Part (b) of FIG. 12 is a plan view of the head 11.

In the present embodiment, the head 11 includes six nozzle rows Na to Nf. The nozzle rows Na and Nb are set as nozzle rows including nozzles used as second nozzle rows N2 configured to discharge the background ink (white ink) serving as the second liquid, and the nozzle rows Nc to Nf are set as nozzle rows including nozzles used as first nozzle rows N1 configured to discharge image forming inks serving as the first liquids.

In this case, the first nozzle rows N1 and the second nozzle rows N2 are distributed in a similar manner to the third embodiment described above.

According to this, the adhesion amount of white ink can be doubled compared with the amount of attached white ink in the third embodiment, and thus the density of the background can be increased to increase the covering property of the white background. If the density of the pigment content is increased to increase the density of the white ink, problems, such as increase in the viscosity of the ink and occurrence of sedimentation of pigment in a liquid cartridge or a supplement path, may be more likely to occur, and thus operability of the ink may be degraded. However, by increasing the number of nozzle rows to discharge white ink, the covering property of the white background can be improved without increasing the density of pigment.

Figure 13:
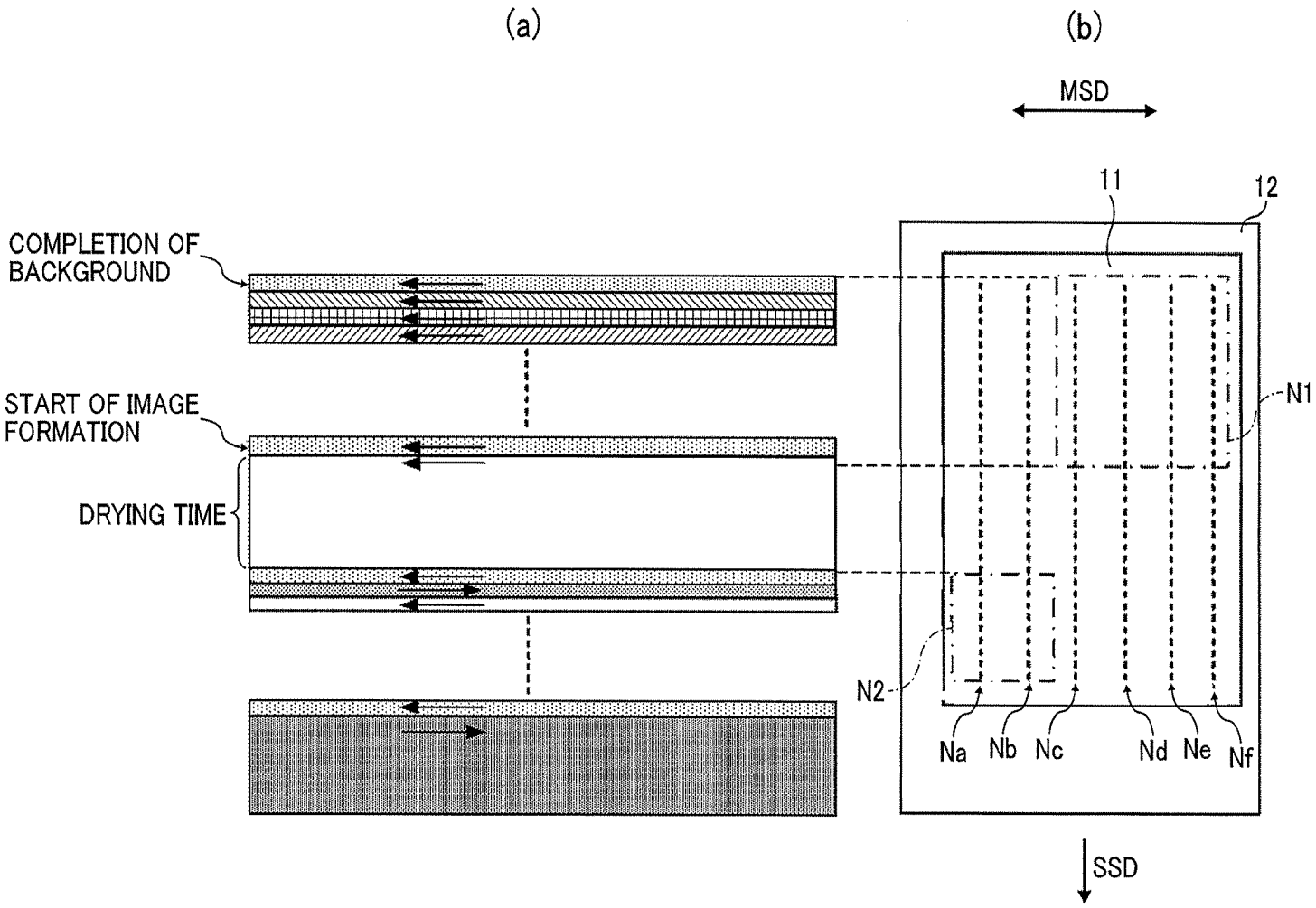
FIG. 13 is a plan view of a fifth embodiment of the present disclosure.

Next, a fifth embodiment of the present disclosure will be described with reference to FIG. 13. FIG. 13 is a plan view of the fifth embodiment. Part (a) of FIG. 13 is a plan view of a printing sequence on the medium 2. Part (b) of FIG. 13 is a plan view of the head 11.

In the present embodiment, the head 11 also includes the six nozzle rows Na to Nf. The nozzle rows Na and Nb are set as nozzle rows including nozzles used as second nozzle rows N2 configured to discharge the white ink serving as the second liquid, and the nozzle rows Nc to Nf are set as nozzle rows including nozzles used as first nozzle rows N1 configured to discharge image forming inks serving as the first liquids.

Nozzles on the upstream side in the sub-scanning direction are assigned to the first nozzle rows N1, and nozzles on the downstream side in the sub-scanning direction are assigned to the second nozzle rows N2. A gap of unused nozzles is provided between the first nozzle rows N1 and the second nozzle rows N2.

According to this, the white background can be printed after an image is printed. In this case, when the medium 2 is transparent, the printed image is viewed from the back side of the transparent medium 2.

Figure 14:
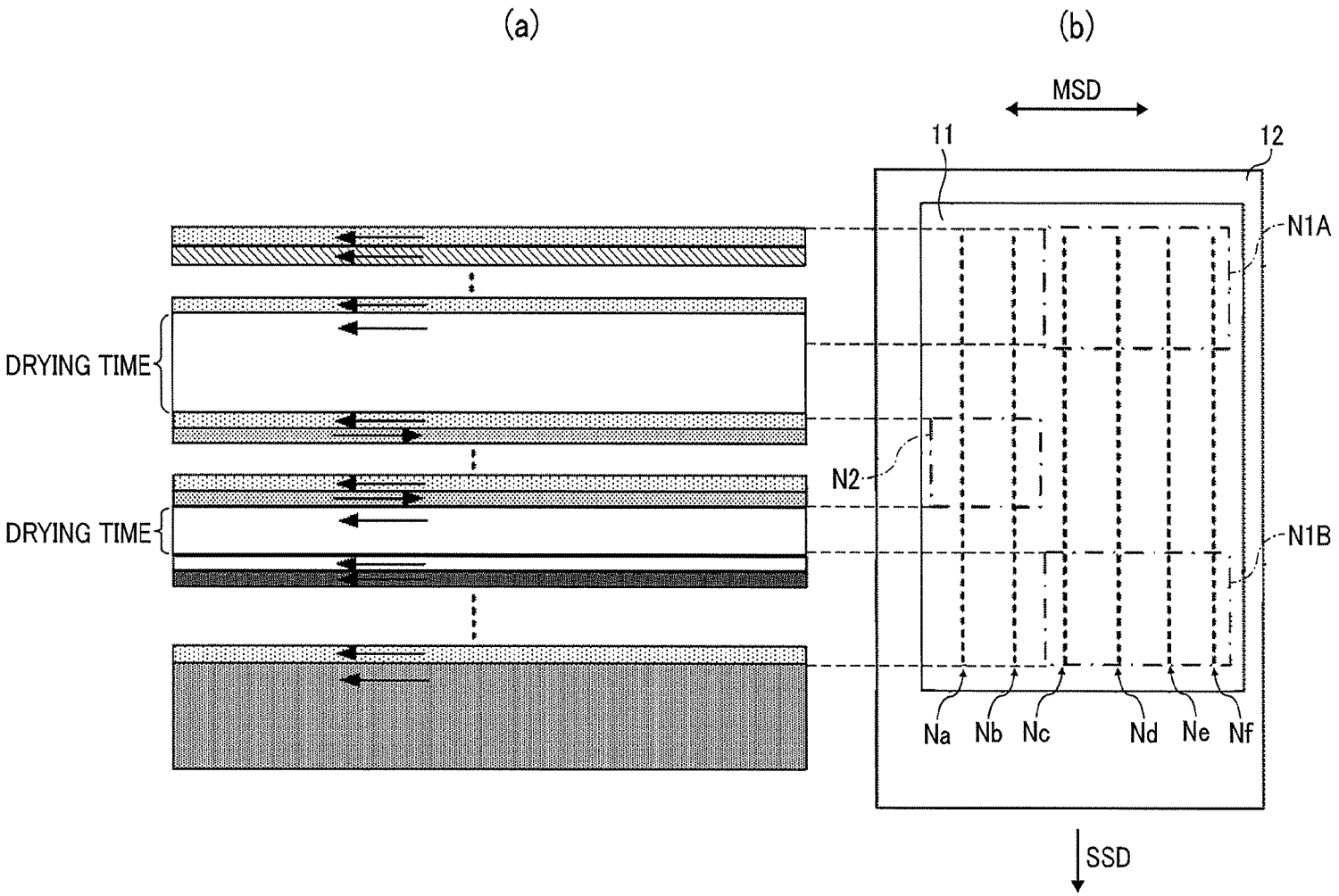
FIG. 14 is a plan view of a sixth embodiment of the present disclosure.

Next, a sixth embodiment of the present disclosure will be described with reference to FIG. 14. FIG. 14 is a plan view of the sixth embodiment. Part (a) of FIG. 14 is a plan view of a printing sequence on the medium 2. Part (b) of FIG. 14 is a plan view of the head 11.

In the present embodiment, the head 11 also includes the six nozzle rows Na to Nf. The nozzle rows Na and Nb are set as nozzle rows including nozzles used as second nozzle rows N2 configured to discharge the white ink serving as the second liquid, and the nozzle rows Nc to Nf are set as nozzle rows including nozzles used as first nozzle rows N1 configured to discharge image forming inks serving as the first liquids.

Nozzles on the upstream side in the sub-scanning direction are assigned to first nozzle rows N1A, nozzles in a center portion in the sub-scanning direction are assigned to the second nozzle rows N2, and nozzles on the downstream side in the sub-scanning direction are assigned to first nozzle rows N1B. A gap of unused nozzles is provided between the first nozzle rows N1A and the second nozzle rows N2, and another gap of unused nozzles is provided between the second nozzle rows N2 and the first nozzle rows N1B.

By employing such a configuration, an image can be first printed on the transparent medium 2 with image forming inks, the background can be then printed on the image with white ink, and an image can be further printed again on the background with image forming inks. By printing images in three layers in this way, the printed image can be viewed from both sides of the medium 2.

In addition, time for drying the image can be ensured by providing a gap of unused nozzles between the first nozzle rows N1A provided on the upstream side and the second nozzle rows N2 provided in the center portion, and the time for drying the white ink can be ensured by providing a gap of unused nozzles between the first nozzle rows N1B provided on the downstream side and the second nozzle rows N2 provided in the center portion.

Figure 16:
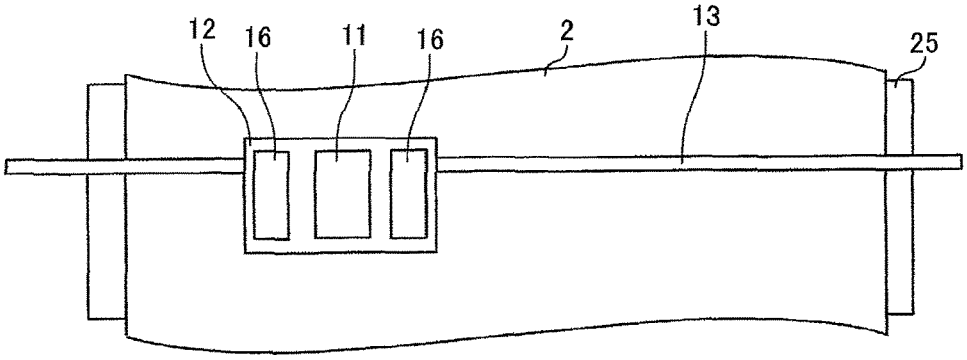
FIG. 16 is a plan view of another configuration of the printing apparatus according to an embodiment of the present disclosure.
Figure 17:
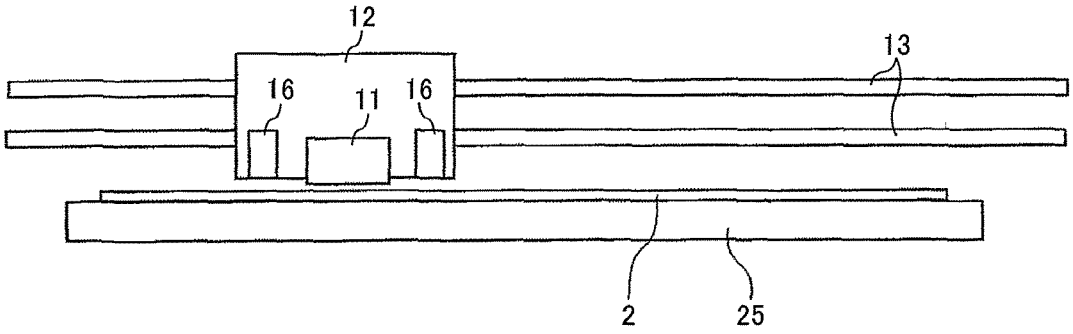
FIG. 17 is a plan view of still another configuration of the printing apparatus according to an embodiment of the present disclosure.

Next, another configuration of the printing apparatus according to an embodiment of the present disclosure is described with reference to FIGS. 16 and 17. FIG. 16 is a plan view of the printing apparatus according to the present embodiment. FIG. 17 is a front view of the printing apparatus according to the present embodiment.

In the present embodiment, the printing apparatus is an apparatus that uses ultraviolet (UV) curable ink as liquid. Ultraviolet-ray irradiators 16 are mounted at both sides of the head 11 on the carriage 12 in the main scanning direction MSD.

The above-described embodiment is described with the example in which the second liquid is a liquid for background. Note that the second liquid is not limited to the liquid for background and may be, for example, a pre-coating liquid (treatment liquid) for reducing image bleeding or enhancing the adhesion of liquid to a medium, clear ink to be formed on an image to protect the image, or a post-coating liquid (treatment liquid) for enhancing the fixing performance.

Program

A program according to an embodiment of the present disclosure causes a computer to perform control to discharge a second liquid onto a region of a medium including another region on which a first liquid is discharged in an image forming apparatus. The image forming apparatus includes a liquid discharge device and a carriage. The liquid discharge device includes a first nozzle row to discharge the first liquid to form an image and a second nozzle row to discharge the second liquid of a type different from the first liquid. The carriage is mounted with the liquid discharge device and reciprocally movable in a main scanning direction. The program causes the computer to perform control to discharge the second liquid from the second nozzle row in both directions of a forward path and a backward path of the carriage and discharge the first liquid from the first nozzle row in one direction of the forward path and the backward path of the carriage. The program according to an embodiment of the present disclosure can be suitably used to execute the printing apparatus according to an embodiment of the present disclosure.

Figure 15:
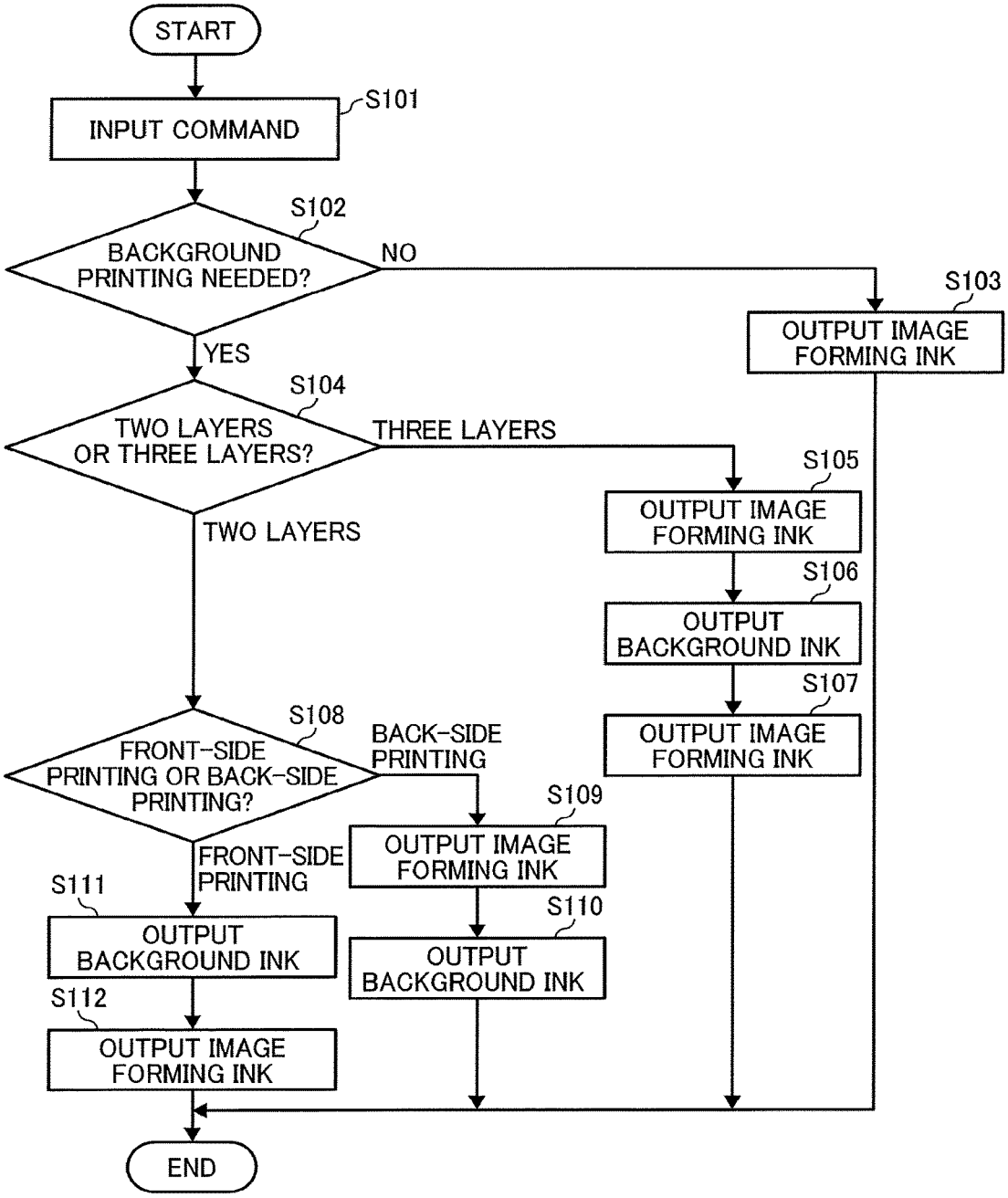
FIG. 15 is a flowchart of an example of a process flow leading to output by the printing apparatus according to an embodiment of the present disclosure.

Next, an exemplary flow leading to output by the printing apparatus is described with reference to a flowchart illustrated in FIG. 15.

A command, such as image information, profile information, heater control information, or output mode information is input from the host device 600, such as a personal computer (S101). The presence or absence of the background to be printed, the number of layers, and a vertical positional relationship between the background and the image can be designated by a user through the host device 600 at the time of forming a layered image. The layered image is formed by layering the background and an image. Information concerning this designation is also included in examples of the command.

The command is analyzed and the presence or absence of the background to be printed is determined (S102).

At this time, in the case where the background is not to be printed (NO at S102), an image is formed by outputting (discharging) normal image forming inks (S103).

In contrast, when the background is to be printed (YES at S102), whether the number of layers to be printed is two or three is determined (S104).

When the number of layers is not two, that is, when the number of layers is three, output of image forming inks, output of background ink, and output of image forming inks are performed (at S105 to S107) to output three layers of image, background (white solid background), and image as described in the sixth embodiment.

In contrast, in the case where the number of layers is two, which of front-side printing and back-side printing is to be performed is determined (S108). In front-side printing, an image is output by using image forming inks on a foundation of background ink (white ink). In back-side printing, an image is output on a transparent medium by using image forming inks, and the background ink (white ink) is output on the image such that the image can be viewed from the back side.

When back-side printing is to be performed, the background ink is output (S110) after outputting the image forming inks (S109) as described in the fifth embodiment. In contrast, in the case where front-side printing is to be performed, the image forming inks are output (S112) after outputting the background ink (S111) as described in the fourth embodiment.

In this way, output can be performed for various background configurations.

In the embodiments described above, a configuration in which image forming inks of four colors of cyan, magenta, yellow, and black are used as the first liquids has been described as an example. However, a configuration in which an image forming ink of a special color is used additionally to the image forming inks of four colors may be employed, and a configuration in which light inks is used additionally to the image forming inks of four colors may be also employed. Examples of the special color include orange, green, red, and blue, and examples of the colors of the light inks include light cyan, light magenta, and gray. In some embodiments, a configuration in which black ink is not used may be employed.

Moreover, although white ink has been described as an example of the background liquid (background ink) serving as the second liquid, a configuration in which a metallic ink of such a color as silver or gold instead of white may be employed.

Ink

Liquid used in the printing apparatus according to embodiments of the present disclosure are not particularly limited. For example, ink can be used as the liquid. The ink may contain, for example, water, organic solvent, colorant, resin particles, and siloxane compound. Such ink can enhance the drying performance and suitably increase the speed of image formation.

The present inventors have found that the fixing performance of ink can be significantly enhanced by adding a siloxane compound to the ink. Although this reason has been unknown, the inventors assume that adding a siloxane compound to ink enhances the affinity of ink with various impermeable media, allowing ink to spread and increase the surface area immediately after the adhesion of ink to a recording medium, and as a result, the drying efficiency is increased. Enhancing the drying performance of the ink on impermeable media can reduce color border bleeding in, for example, white preceding-printing, white succeeding-printing, and three-layer printing, thus obtaining high-quality image.

To enhance the print quality, it may be preferable to match the glossiness of white ink image with the glossiness of color ink image. For example, when unidirectional printing is performed using a white ink of high drying performance and a color ink, irregularities may occur in the white ink and reduce the glossiness. Accordingly, the glossiness of the color ink image may become higher than the white ink image, resulting in a difference in glossiness between the color ink image and the white ink image. With the printing apparatus according to embodiments of the present disclosure, white ink is changed from unidirectional printing to bidirectional printing to differentiate the drying time between the white ink and the color ink, thus allowing even glossiness. That is, in bidirectional printing, the drying performance of white ink is raised to be higher than the drying performance of color ink, thus reducing unevenness in glossiness in unidirectional printing.

The white preceding-printing is a printing method of forming an image with color ink after at least one of foundation and background is formed with white ink. The white succeeding-printing is a printing method of forming at least one of foundation and background with white ink after an image is formed with color ink. The three-layer printing is a printing method of forming an image with color ink, forming at least one of foundation and background with white ink, and further forming an image with color ink.

<Siloxane Compound>

The siloxane compound is not limited to any particular compound and can be appropriately selected according to the intended purpose. Examples of the siloxane compound include compounds group having a hydrophilic functional group or a hydrophilic polymer chain at at least one of a side chain and a terminal part of a compound (silicone compounds) including a polysiloxane part, such as polydimethylsiloxane.

Examples of the hydrophilic functional group or the hydrophilic polymer chain include polyether bonding groups (e.g., polyethylene oxide, polypropylene oxide, and copolymers thereof), polyglycerin (e.g., $C_3H_6O(CH_2CH(OH)CH_2O)_n$—H), pyrrolidone, betaines (e.g., $C_3H_6N+Me_2$-$CH_2COO$—), sulfates (e.g., $C_3H_6O(C_2H_4O)n$-$SO_3Na$), phosphates (e.g., $C_3H_6O(C_2H_4O)_n$—P(=O)OHONa), and quaternary salts (e.g., $C_3H_6N+Me_3Cl$—). Note that, in the chemical formula, n represents an integer of 1 or more.

Moreover, as the hydrophilic functional group and the hydrophilic polymer chain, a vinyl-based copolymer may be used, where the vinyl-based copolymer includes, at a side chain, a silicone-based compound chain (e.g., polydimethylsiloxane), which is obtained through copolymerization of polydimethylsiloxane incorporating a polymerizable vinyl group into a terminal part and another monomer capable of copolymerizing with the polydimethylsiloxane (at least one part of the monomer preferably includes a hydrophilic monomer such as (meth)acrylic acid or a salt thereof). Among them, compounds having a polysiloxane part and a hydrophilic polymer chain are preferable. The hydrophilic polymer chain preferably contains polyether bond.

The siloxane compound is preferably a nonionic surfactant having a structure of methylpolysiloxane at the hydrophobic group and polyoxy-ethylene at the hydrophilic group.

An HLB value of the siloxane compound is preferably 8.0 or less. When the HLB value is 8.0 or less, the drying performance of ink recorded on an impermeable medium can be enhanced.

The HLB (Hydrophile-Lipophile Balance) is obtained by the Griffin's method represented by the following equation 1:

$$HLB=20+(\text{total of formula weight of hydrophilic part/molecular weight}) \quad \text{Equation 1}$$

The siloxane compound is not limited to any particular compound and can be selected according to the intended purpose. The siloxane compound may be a commercially available product. Examples of the commercially available product include: SILFACE SAG 005 (manufactured by Nissin Chemical Industry Co., Ltd.; HLB=7.0) and SILFACE SAG 008 (manufactured by Nissin Chemical Industry Co., Ltd.; HLB=7.0); FZ-2110 (manufactured by Dow Corning Toray Co., Ltd.; HLB=1.0), FZ-2166 (manufactured by Dow Corning Toray Co., Ltd.; HLB=5.8), SH-3772M (manufactured by Dow Corning Toray Co., Ltd.; HLB=6.0), L7001 (manufactured by Dow Corning Toray Co., Ltd.; HLB=7.4), and SH-3773M (manufactured by Dow Corning Toray Co., Ltd.; HLB=8.0); KF-945 (manufactured by Shin-Etsu Chemical Co., Ltd.; HLB=4.0), KF-6017 (manufactured by Shin-Etsu Chemical Co., Ltd.; HLB=4.5); and FormBan MS-575 (manufactured by Ultra Addives Inc.; HLB=5.0). These may be used alone or in combination.

An amount of the siloxane compound is preferably 0.1% by mass or more but 4.0% by mass or less, more preferably 1.0% by mass or more but 2.0% by mass or less, relative to the total amount of the ink. When the amount is 1.0% by mass or more but 2.0% by mass or less, the fixing performance of ink on impermeable print media can be improved, thus allowing enhancement of image qualities, such as gloss level.

By adding the siloxane compound to ink can enhance the drying performance of ink, bidirectional printing can be performed for a drying time equivalent to a drying time of unidirectional printing without increasing unused nozzles. Adjustment of the amount of the siloxane compound and the length of unused nozzles allows the drying time to be optimal.

<Resin Particles>

The resin particles are not limited to any particular resin particles and can be selected according to the intended purpose. Examples of the resin particles include: condensation synthetic resin particles, such as polyester resin particles, polyurethane resin particles, epoxy resin particles, polyamide resin particles, polyether resin particles, acrylic resin particles, acrylic-silicone resin particles, and fluorine-based resin particles; additive synthetic resin particles, such as polyolefin resin particles, polystyrene-based resin particles, polyvinyl alcohol based resin particles, polyvinylester-based resin particles, polyacrylic acid based resin particles, and unsaturated carboxylic acid-based resins; and natural polymers, such as celluloses, rosins, and natural rubber. These may be used alone or in combination. Among them, polyurethane resin particles are preferable from the point of view of dispersion stability and high glossiness of the ink. For the polyurethane resin particles, good dispersiveness of the siloxane compound can be obtained. As a result, the film-forming performance of ink can be enhanced, thus enhancing the drying performance and the speed of image formation.

The resin particles are not limited to any particular particles and can be selected according to the intended purpose. For example, the resin particles may be appropriately synthesized or may be commercially available products.

<<Polyurethane Resin Particles>>

The polyurethane resin particles are not particularly limited and may be appropriately selected according to the intended purpose. Examples of the polyurethane resin particles include polyurethane resin particles obtained by reacting polyol with polyisocyanate.

—Polyol—

Examples of the polyol include polyether polyols, polycarbonate polyols, and polyester polyols. These may be used alone or in combination.

—Polyether Polyol—

Examples of the polyether polyols include polyether polyol obtained by allowing at least one of compounds including two or more active hydrogen atoms serving as a starting material, to polymerize through addition of alkylene oxide.

The starting material is not limited to any particular material and can be appropriately selected according to the intended purpose. Examples of the starting material include ethylene glycol, diethylene glycol, triethylene glycol, propylene glycol, trimethylene glycol, 1,3-butanediol, 1,4-butanediol, 1,6-hexanediol, glycerin, trimethylolethane, and trimethylolpropane. These may be used alone or in combination.

The alkylene oxide is not particularly limited and can be appropriately selected according to the intended purpose. Examples of the alkylene oxide include ethylene oxide, propylene oxide, butylene oxide, styrene oxide, epichlorohydrin, and tetrahydrofuran. These may be used alone or in combination.

The polyether polyols are not particularly limited and can be appropriately selected according to the intended purpose. For example, polyoxytetramethylene glycols and polyoxypropylene glycols may be used in order to obtain a binder for an ink, which can impart a considerably excellent rubfastness to the ink. These may be used alone or in combination.

—Polycarbonate Polyol—

The polycarbonate polyol is not particularly limited and can be appropriately selected according to the intended purpose. Examples of the polycarbonate polyol include a polycarbonate polyol obtained by reacting ester carbonate with polyol and a polycarbonate polyol obtained by reacting phosgene with bisphenol A. These may be used alone or in combination.

The ester carbonate is not particularly limited and can be appropriately selected according to the intended purpose. Examples of the ester carbonate include methyl carbonate, dimethyl carbonate, ethyl carbonate, diethyl carbonate, cyclocarbonate, and diphenyl carbonate. These may be used alone or in combination.

The polyol is not limited to any particular compound and can be appropriately selected according to the intended purpose. Examples of the polyol include: dihydroxy compounds having a relatively low molecular weight, such as ethylene glycol, diethylene glycol, triethylene glycol, 1,2-propylene glycol, 1,3-propylene glycol, dipropylene glycol, 1,4-butanediol, 1,3-butanediol, 1,2-butanediol, 2,3-butanediol, 1,5-pentanediol, 1,5-hexanediol, 2,5-hexanediol, 1,6-hexanediol, 1,7-hepetanediol, 1,8-octanediol, 1,9-nonanediol, 1,10-decanediol, 1,11-undecanediol, 1,12-dodecanediol, 1,4-cyclohexanediol, 1,4-cyclohexanedimethanol, hydroquinone, resorcin, bisphenol-A, bisphenol-F, and 4,4'-biphenol; polyether polyols, such as polyethylene glycols, polypropylene glycols, and polyoxytetramethylene glycols; and polyester polyols, such as polyhexamethylene adipates, polyhexamethylene succinates, and polycaprolactones. These may be used alone or in combination.

—Polyester Polyol—

The polyester polyol is not particularly limited and can be appropriately selected according to the intended purpose. Examples of the polyester polyols include polyester polyols obtained by allowing a low-molecular-weight polyol and polycarboxylic acid to undergo esterification reaction, polyesters obtained by allowing a cyclic ester compound (e.g., ε-caprolactone) to undergo ring-opening polymerization reaction, and copolymerized polyesters of these polyesters. These may be used alone or in combination.

The polyol having a relatively low molecular weight is not particularly limited and can be appropriately selected according to the intended purpose. Examples of the polyol include ethylene glycol and ethylene glycol. These may be used alone or in combination.

The polycarboxylic acid is not particularly limited and can be appropriately selected according to the intended purpose. Examples of the polycarboxylic acid include succinic acid, adipic acid, sebacic acid, dodecanedicarboxylic acid, terephthalic acid, isophthalic acid, phthalic acid, and anhydrides or ester-forming derivatives of these acids. These may be used alone or in combination.

—Polyisocyanate—

The polyisocyanate is not particularly limited and can be appropriately selected according to the intended purpose. Examples of the polyisocyanate include: aromatic diisocyanates, such as phenylene diisocyanate, tolylene diisocyanate, diphenylmethane diisocyanate, and naphthalene diisocyanate; and aliphatic or alicyclic diisocyanates, such as hexamethylene diisocyanate, lysine diisocyanate, cyclohexane diisocyanate, isophorone diisocyanate, dicyclohexylmethane diisocyanate, xylylene diisocyanate, tetramethylxylylene diisocyanate, and 2,2,4-trimethylhexamethylene diisocyanate. These may be used alone or in combination. Among these examples, aliphatic or alicyclic diisocyanates are preferable. Aliphatic or alicyclic diisocyanates can form a coating film having a remarkably-high long-term weather resistance and can be used for outdoors as, for example, poster and signboard. Furthermore, additional use of at least one alicyclic diisocyanate can provide a coating film having an intended strength and an intended rubfastness in image formation.

The alicyclic diisocyanate is not particularly limited and can be appropriately selected according to the intended purpose. Examples of the alicyclic diisocyanates include isophorone diisocyanate and dicyclohexylmethane diisocyanate. These may be used alone or in combination.

An amount of the alicyclic diisocyanate is preferably 60% by mass or more relative to the total amount of polyurethane resin.

<<Method for Producing Polyurethane Resin Particles>>

The polyurethane resin particles can be obtained by a normally-used producing method, such as the following method. First, in the absence of a solvent or in the presence of an organic solvent, the polyol is allowed to react with the polyisocyanate in an equivalent ratio so that isocyanate groups are excessively present, to produce an isocyanate-terminated urethane prepolymer. Next, anionic groups in the isocyanate-terminated urethane prepolymer are optionally neutralized with a neutralizing agent and allowed to react with a chain extender, and, finally, the organic solvent in a system is optically removed. As a result, the polyurethane resin particles are obtained.

An organic solvent that can be used for producing the polyurethane resin particles is not particularly limited and can be appropriately selected according to the intended purpose. Examples of the organic solvent that can be used for producing the polyurethane resin particles include: ketones, such as acetone and methyl ethyl ketone; ethers, such as tetrahydrofuran and dioxane; ester acetates, such as ethyl acetate and butyl acetate; nitriles, such as acetonitrile; and amides such as dimethyl formamide, N-methylpyrrolidone, and N-ethylpyrrolidone. These may be used alone or in combination.

The chain extender is not particularly limited and can be appropriately selected according to the intended purpose. Examples of the chain extender include polyamine and other active hydrogen group-containing compounds. These may be used alone or in combination.

The polyamine is not particularly limited and can be appropriately selected according to the intended purpose. Examples of the polyamines include: diamines, such as ethylene diamine, 1,2-propane diamine, 1,6-hexamethylenediamine, piperazine, 2,5-dimethyl piperazine, isophoronediamine, 4,4'-dicyclohexylmethane diamine, and 1,4-cyclohexane diamine; polyamines such as diethylenetriamine, dipropylene triamine, and triethylene tetramine; hydrazines such as hydrazine, N,N'-dimethyl hydrazine, and 1,6-hexamethylene bishydrazine; and dihydrazides such as succinic dihydrazide, adipic dihydrazide, glutaric dihydrazide, sebacic dihydrazide, and isophthalic dihydrazide. These may be used alone or in combination.

The other active hydrogen group-containing compounds are not particularly limited and can be appropriately selected according to the intended purpose. Examples of the other active hydrogen group-containing compounds include glycols, such as ethylene glycol, diethylene glycol, triethylene glycol, propylene glycol, 1,3-propanediol, 1,3-butanediol, 1,4-butanediol, hexamethylene glycol, saccharose, methylene glycol, glycerin, and sorbitol; phenols such as bisphenol A, 4,4'-dihyroxy diphenyl, 4,4'-dihydroxydiphenyl ether, 4,4'-dihydroxydiphenyl sulfone, hydrogenated bisphenol A, and hydroquinone; and water. These may be used alone or in combination so long as the ink is not deteriorated in storage stability.

As the polyurethane resin particles, for example, polycarbonate-based urethane resin is preferable from the viewpoint of high glossiness. Use of the polycarbonate-based polyurethane resin particles can provide an ink that can retain high glossiness in a recorded material used in a severe environment, such as outdoor.

The polyurethane resin particles may be commercially available products. Examples of the commercially available products include YUKOTO UX-485 (polycarbonate-based urethane resin particles), YUKOTO UWS-145 (polyester-based urethane resin particles), PAMARIN UA-368T (polycarbonate-based urethane resin particles), and PAMARIN UA-200 (polyether-based urethane resin particles), which are all manufactured by Sanyo Chemical Industries, Ltd. These may be used alone or in combination.

A volume average particle diameter of the resin particles is preferably 10 nm or more but 1,000 nm or less, more preferably 10 nm or more but 200 nm or less, particularly preferably 10 nm or more but 100 nm or less. When the resin particles having the volume average particle diameter of 10 nm or more but 1,000 nm or less is used in an ink discharge apparatus including a circulation unit to circulate ink, excellent ink supply performance and discharge reliability can be obtained. Further, the resin particles are easy to dissolve in organic solvent when ink dries on a print material, such as a print medium, and the effect of spreading of resin is easy to be obtained, thus allows formation of highly gloss images.

The method of measuring the volume average particle diameter is not particularly limited and can be appropriately selected according to the intended purpose. The volume average particle diameter can be measured using, for example, a particle size analyzer (Product name of MICROTRAC MODEL UPA 9340 manufactured by Nikkiso Co., Ltd.).

When the resin particles are contained in ink, the total amount of the resin particles is preferably 1% by mass or more but 15% by mass or less from the viewpoint of dispersion stability of the ink, more preferably 5% by mass or more but 12% by mass or less from the viewpoints of high glossiness and enhancement of the fixing performance relative to the base material and the smoothness of coating film, particularly preferably 5% by mass or more but 10% by mass or less, relative to the total amount of the ink.

Qualitative and quantitative properties of the resin particles can be confirmed according to a method as detailed in, for example, Yasuda, Takeo, "Test methods and evaluation results of dynamic characteristics of plastic materials (22)", Plastics: Journal of the Japan Plastics Industry Federation, "Plastics" editors board. Specifically, qualitative and quantitative properties of the resin particles can be confirmed with an analysis using a measuring device as described below.

Infrared Spectroscopy (IR)

Qualitative analysis of the resin particles can be performed by measuring the absorption wavelengths of various functional groups of the resin particles and comparing the measured wavelengths with IR spectra of the known resin particles. Comparison of the relative amounts of several types of monomers and resin particles can be performed by comparing the absorbance of functional groups of the resin particles.

Heat Analysis (DS/A, TG/DTA)

Polymers can be identified by measuring, for example, the fusion point and the glass transition temperature of resin particles according to differential scanning calorimetry (DS/A) or differential thermal analysis (DTA).

Pyrolysis Gas Chromatography (PyGC)

Pyrolysis products are separated by gas chromatography, and composition analysis and structure analysis can be performed on the pyrolysis products. Note that more accurate analysis can be performed by preliminarily identifying the pyrolysis products generated by pyrolysis with a mass spectrometer directly connected to PyGC.

Nuclear Magnetic Resonance (NMR)

Resin particles can be identified and confirmed by comparing the resin particles with the spectra of the known resin particles. For unknown resin particles, the molecular structure can be determined. Further, the composition ratio or blend ratio of copolymer or a blended materials of a plurality of polymers can be quantitatively analyzed.

To increase the accuracy of analysis, it is effective to perform pretreatment before analysis of resin particles with the measuring device. The pretreatment is performed by, for example, settling colorant components in ink by centrifugation and collecting a supernatant containing the resin particles, or extracting the resin particles with a proper organic solvent.

Heating after the recording can reduce residual solvent, thus enhancing the adhesion performance. Particularly, when a minimum film-forming temperature (hereinafter may also be referred to as "MFT") of the resin particles is higher than 80° C., heating is preferably performed in terms of eliminating a film forming failure of the resin and improving image robustness.

Here, the minimum film-forming temperature refers to a lowest possible temperature at which emulsion thinly cast over a metal plate, such as aluminum, forms a transparent continuous film as a result of temperature elevation, and refers to a temperature at which the emulsion is in a white powder state in a temperature range lower than the minimum film-forming temperature. For example, the minimum film-forming temperature refers to a value measured by a commercial minimum film-forming temperature measuring device, such as a film-forming temperature testing device (manufactured by IMOTO MACHINERY CO., LTD.) or TP-801 MFT tester (manufactured by TESTER SANGYO CO., LTD.). The minimum film-forming temperature is changed by control of the particle diameter of resin. Therefore, the minimum filming temperature of resin can be a target value by control factors, such as the particle diameter.

As a method of adjusting the minimum film-forming temperature of the resin emulsion, for example, the minimum film-forming temperature can adjusted by controlling a glass transition temperature (hereinafter may also be referred to as "Tg") of the resin. When the resin particles are made of a copolymer, the minimum film-forming temperature can be adjusted by changing the ratios of monomers forming the copolymer.

<Organic Solvent>

The organic solvent is not particularly limited and can be appropriately selected according to the intended purpose. Examples of the organic solvent include water-soluble organic solvents and the compounds represented by the following General Formula (1):

Chemical Formula 1

GENERAL FORMULA (1)

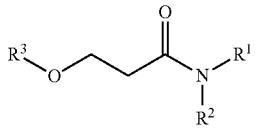

where in the General Formula (1), $R^1$, $R^2$, and $R^3$ each represent an alkyl group having 1 or more but 5 or less carbon atoms, and $R^1$, $R^2$, and $R^3$ may be identical to or different from each other.

—Water-Soluble Organic Solvent—

Examples of the water-soluble organic solvent include: polyvalent alcohols, such as ethylene glycol, diethylene glycol, 1,2-propanediol, 1,3-propanediol, 1,2-butanediol, 1,3-butanediol, 2,3-butanediol, 3-methyl-1,3-butanediol, 2-methyl-2,4-pentanediol, triethylene glycol, polyethylene glycol, polypropylene glycol, 1,5-pentanediol, 1,6-hexanediol, glycerin, 1,2,6-hexanetriol, 2-ethyl-1,3-hexanediol, 1,2,4-butanetriol, 1,2,3-butanetriol, and 3-methyl-1,3,5-pentanetriol; polyvalent alcohol alkylethers, such as ethylene glycol monoethylether, ethylene glycol monobutylether, diethylene glycol monomethylether, diethylene glycol monoethylether, diethylene glycol monobutylether, tetraethylene glycol monomethylether, dipropylene glycol monomethylether, and propylene glycol monoethyl ether; polyvalent alcohol arylethers, such as ethylene glycol monophenylether and ethylene glycol monobenzylether; nitrogen-including heterocyclic compounds, such as 2-pyrrolidone, N-methyl-2-pyrrolidone, N-hydroxyethyl-2-pyrrolidone, 1,3-dimethylimidazolidinone, ε-caprolactam, and γ-butyrolactone; amides, such as formamide, N-methylformamide, and N,N-dimethylformamide; amines, such as monoethanolamine, diethanolamine, and triethylamine; sulfur-including compounds, such as dimethylsulfoxide, sulfolane, and thiodiethanol; propylene carbonate; and ethylene carbonate. These may be used alone or in combination. Among the examples, 1,2-propanediol, 1,3-propanediol, 1,2-butanediol, 1,3-butanediol, 2,3-butanediol, 2-methyl-2,4-pentanediol, and dipropylene glycol monomethylether are preferable from the viewpoints of high glossiness and prevention of particles aggregation. From the viewpoints of high rubfastness, high solvent resistance, and facilitation of film-forming of the resin, for example, 1,2-propanediol and 1,2-butanediol, each having a boiling point of 200° C. or less, are preferable.

The amount of the organic solvent is not particularly limited but may be preferably 20% by mass or more but 70% by mass or less, more preferably 30% by mass or more but 60% by mass or less relative to the total amount of the ink. When the amount is 20% by mass or more but 70% by mass or less, excellent drying performance and good discharge stability can be obtained.

—Compound Represented by General Formula (1)—

A compound represented by General Formula (1) facilitates film-forming of resin in the process of drying ink, thus allowing enhancement of drying performance.

In the General Formula (1), $R^1$, $R^2$, and $R^3$ each represent an alkyl group having 1 or more but 5 or less carbon atoms, and $R^1$, $R^2$, and $R^3$ may be identical to or different from each other.

Examples of the alkyl group including 1 or more but 5 or less carbon atoms include, but are not limited to, a methyl group, an ethyl group, a propyl group, an isopropyl group, a butyl group, and a pentyl group.

Examples of the compound represented by General Formula (1) include, but are not limited to, 3-methoxy-N, N-dimethyl propionamide, 3-butoxy-N represented by the following Structural Formula (1-1), 3-butoxy-N, N-dimethyl propionamide represented by the following Structural Formula (1-2), and 3-methoxy-N, N-diethyl propionamide. These may be used alone or in combination. Among the examples, 3-methoxy-N, N-dimethyl propionamide represented by the following Structural Formula (1-1) is preferable from the viewpoints of drying performance, fixing performance, rubfastness, non-transferability, and high glossiness.

Chemical Formula 2

STRUCTURAL FORMULA (1-1)

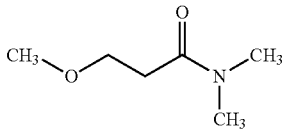

Chemical Formula 3

STRUCTURAL FORMULA (1-2)

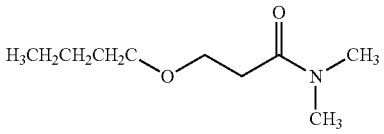

The compound represented by General Formula (1) can enhance the compatibility of organic solvent with the resin particles. thus enhancing the dispersiveness. The compound represented by General Formula (1) is highly permeable to impermeable media, thus ensuring sufficient wettability to the base material of ink. Accordingly, further excellent drying performance of ink of an image can be obtained.

As to the compound represented by General Formula (1), resin particles may be used together with an organic solvent, such as 1,2-propanediol, 1,3-propanediol, 1,2-butanediol, 1,3-butanediol, or 2,3-butanediol, having a relatively low boiling point and a certain level of affinity with the resin particles. Such a compound can ensure the dispersion stability of resin particles in ink and enhance the evenness of a solid image area after recording, thus achieving excellent image quality.

As the compound represented by General Formula (1), a commercial product can be used. Examples of the commercial product include, but are not limited to, ECUAMIDE M-100 (a product name manufactured by Idemitsu Kosan Co., Ltd., 3-methoxy-N, N-dimethyl propionamide having a methyl group at R1, a methyl group at R2, and a methyl group at R3 in above-described General Formula) and ECUAMIDE B-100 (a product name manufactured by Idemitsu Kosan Co., Ltd., 3-butoxy-N, N-dimethyl propionamide having a methyl group at R1, a methyl group at R2, and a butyl group at R3 in the above-described General Formula). These may be used alone or in combination.

An amount of the compound represented by the following General Formula (1) is preferably 5% by mass or more but 55% by mass or less, more preferably 10% by mass or more but 45% by mass or less, relative to the total amount of the ink. When the amount is 5% by mass or more but 55% by mass or less, the effect of being evenly mixed can be enhanced, thus achieving good discharge performance when the compound is used for an inkjet printing method. Such a composition can facilitate production of Ink having excellent wettability to impermeable media.

The amount of the compound represented by General Formula (1) can be confirmed by, for example, a gas chromatography mass spectrometry (GCMS) method. For example, ink is analyzed by the gas chromatography mass spectrometry (GCMS) method to perform qualitative analysis on a solvent contained in ink. When the type of solvent is identified, the calibration curve of the concentration of each solvent can be generated to quantitate each solvent contained in the ink.

<Water>

In the printing apparatus according to an embodiment of the present disclosure, a solvent ink containing no water can be used. However, aqueous ink containing water can be used as an ink having a high degree of safety without affecting environments. The water used in the aqueous ink is not particularly limited and can be appropriately selected according to the intended purpose. Examples of the water include pure water, such as deionized water, ultrafiltrated water, reverse osmotic water, and distilled water; and ultrapure water. These may be used alone or in combination.

The amount of the water is preferably 15% by mass or more but 60% by mass or less relative to the total amount of the ink. When the amount is 15% by mass or more, the ink can be prevented from increasing viscosity, which results in improvement of discharging stability. When the amount is 60% by mass or less, good wettability to impermeable media can be obtained, thus enhancing image qualities.

<Other Components>

Examples of other components include, but are not limited to, a colorant, a preservative and fungicide, a corrosion inhibitor, a pH regulator, and a colorless anti-oxidant agent for rubber and plastic, such as hindered phenol and hindered phenol.

<Colorant>

The colorant is not particularly limited and can be appropriately selected according to the intended purpose. Examples of the colorant include, but are not limited to, white colorant and image forming colorants (colorants for image formation).

—White Colorant—

As to the standard of whiteness of the white colorant, for example, when the value of whiteness measured based on ISO-2469 (JIS-8148) is 70 or more, the white colorant is used as a colorant of white ink. The white ink can be preferably used as the second liquid in the printing apparatus according to an embodiment of the present disclosure, and can be used for at least any of background and foundation.

Examples of the white colorant include, but are not limited to, titanium oxide, iron oxide, tin oxide, zirconium oxide, and iron titanate (composite oxide of iron and titan).

—Image Forming Colorant—

The image forming colorant can be preferably used as a colorant for image forming ink. The image forming ink can be preferably used as the first liquid in the printing apparatus according to an embodiment of the present disclosure.

Examples of the image forming ink include, but are not limited to, color ink (hereinafter may also referred to as process color ink), special color ink, black ink, gray ink, clear ink, metallic ink, and non-white ink. Note that the clear ink means ink containing mainly resin particles, organic solvent, and water, without containing colorant.

Examples of the color ink include, but are not limited to, cyan ink, magenta ink, yellow ink, light cyan ink, light magenta ink, red ink, green ink, blue ink, orange ink, and violet ink.

The image forming colorant is not particularly limited and can be appropriately selected according to the intended purpose if the image forming colorant has a non-white color. Examples of the image forming colorant include dyes and pigments. These may be used alone or in combination. Among them, pigments are preferable.

Examples of the pigments include inorganic pigments and organic pigments.

Examples of the inorganic pigments include, but are not limited to, titanium oxide, iron oxide, calcium carbonate, barium sulfate, aluminum hydroxide, barium yellow, cadmium red, and chrome yellow, and in addition, carbon blacks produced by known methods such as a contact method, a furnace method, and a thermal method. These may be used alone or in combination.

Specific examples of the organic pigments include, but are not limited to, azo pigments, polycyclic pigments, dye chelates, nitro pigments, nitroso pigments, and aniline black. These may be used alone or in combination.

Examples of the azo pigments include, but are not limited to, azo lakes, insoluble azo pigments, condensed azo pigments, and chelate azo pigments. These may be used alone or in combination.

Examples of the polycyclic pigments include, but are not limited to, phthalocyanine pigments, perylene pigments, perinone pigments, anthraquinone pigments, quinacridone pigments, dioxazine pigments, indigo pigments, thioindigo pigments, isoindolinone pigments, and quinophthalone pigments. These may be used alone or in combination.

Examples of the dye chelates include, but are not limited to, basic dye chelates and acid dye chelates. These may be used alone or in combination.

Other usable examples include hollow resin particles and inorganic hollow particles. Among the above pigments, pigments having good affinity with a solvent are preferably used.

Examples of the pigments for black include, but are not limited to, carbon blacks (C.I. Pigment Black 7), such as furnace black, lamp black, acetylene black, and channel black; metals, such as copper, iron (C.I. Pigment Black 11), and titanium oxide; and organic pigments, such as aniline black (C.I. Pigment Black 1). These may be used alone or in combination.

Examples of the pigments for colors include, but not are not limited to, C. I. Pigment Yellow 1, 3, 12, 13, 14, 17, 24, 34, 35, 37, 42 (yellow iron oxide), 53, 55, 74, 81, 83, 95, 97, 98, 100, 101, 104, 108, 109, 110, 117, 120, 138, 150, 153, and 155; C. I. Pigment Orange 5, 13, 16, 17, 36, 43, and 51; C. I. Pigment Red 1, 2, 3, 5, 17, 22, 23, 31, 38, 48:2, 48:2 (Permanent Red 2B (Ca)), 48:3, 48:4, 49:1, 52:2, 53:1, 57:1 (Brilliant Carmine 6B), 60:1, 63:1, 63:2, 64:1, 81, 83, 88, 101 (colcothar), 104, 105, 106, 108 (Cadmium Red), 112, 114, 122 (Quinacridone Magenta), 123, 146, 149, 166, 168, 170, 172, 177, 178, 179, 185, 190, 193, 209, and 219; C. I. Pigment Violet 1 (rhodamine lake), 3, 5:1, 16, 19, 23, and 38; C. I. Pigment Blue 1, 2, 15 (Phthalocyanine blue), 15:1, 15:2, 15:3 (Phthalocyanine blue), 16, 17:1, 56, 60, and 63; and C. I. Pigment Green 1, 4, 7, 8, 10, 17, 18, and 36. These may be used alone or in combination.

Other examples of the pigments include, but are not limited to, self-dispersion pigments in which a functional group, such as sulfone group or carboxyl group, may be introduced to the surface of a pigment (e.g., carbon black) to make the pigment self-dispersible in water. Other examples of the pigments include, but are not limited to, pigments enclosed in micro capsules to be dispersible in water, that is, resin fine particles containing pigment particles. In such a case, in the pigment contained in ink, all pigment particles need not be enclosed in or adsorbed to the resin fine particles and pigment may be dispersed in ink.

A number average particle diameter of the pigment is not particularly limited and can be appropriately selected according to the intended purpose. The number average particle diameter is preferably 20 nm or more but 150 nm or less in terms of the maximum number conversion. Preferably, the number average particle diameter satisfying 20 nm or more makes it easier to perform the dispersion operation and the classification operation, and the number average particle diameter satisfying 150 nm or less makes it possible to obtain the ink composition achieving dispersion stability of the pigment, and being excellent in discharging stability, which achieves high image quality, such as favorable image density. The number average particle diameter can be measured using, for example, a particle size analysis apparatus (MICROTRAC MODEL UPA 9340, manufactured by Nikkiso Co., Ltd.).

When the pigment is dispersed with dispersant, any known dispersant can be used. Examples of the dispersant include, but are not limited to, polymer dispersant and water-soluble surfactant. These may be used alone or in combination.

Examples of the dyes include, but are not limited to, C. I. Acid Yellow 17, 23, 42, 44, 79, and 142; C. I. Acid Red 52, 80, 82, 249, 254, and 289; C. I. Acid Blue 9, 45, and 249; C. I. Acid Black 1, 2, 24, and 94; C. I. Food Black 1 and 2; C. I. Direct Yellow 1, 12, 24, 33, 50, 55, 58, 86, 132, 142, 144, and 173; C. I. Direct Red 1, 4, 9, 80, 81, 225, and 227; C. I. Direct Blue 1, 2, 15, 71, 86, 87, 98, 165, 199, and 202; C. I. Direct Black 19, 38, 51, 71, 154, 168, 171, and 195; C. I. Reactive Red 14, 32, 55, 79, and 249; C. I. Reactive Black 3, 4, and 35. These may be used alone or in combination.

The colorant used for the metallic ink may be, but not limited to, fine powder prepared by finely pulverizing simple metal, metal alloy, or metal compound.

Examples of the colorant used for the metallic ink include, but not limited to, a group of simple metals including aluminum, silver, gold, nickel, chromium, lead, zinc, indium, titan, silicon, copper, and platinum. These may be used alone or in combination. The colorant used for the metallic ink may also be, but not limited to, an alloy made of at least two of the group of simple metals. Examples of the colorant include, but not limited to, further include particles obtained by finely pulverizing oxides, nitrides, sulfides, or carbides of the group of simple metals or alloys. These may be used alone or in combination.

<Preservative and Fungicide>

The preservative and fungicide are not particularly limited. Examples of the preservative and fungicide include, but not limited to, 1,2-benzisothiazolin-3-one.

<pH Regulator>

The pH regulator is not particularly limited so long as it can adjust the pH to 7 or more. Examples of the pH regulator include amines, such as diethanol amine and triethanol amine.

Method for Producing Ink

As the method for producing the ink, for example, water, an organic solvent, a compound represented by General Formula (1), resin particles, and other components as needed are dispersed or dissolved in aqueous medium, and appropriately stirred and mixed to produce the ink. For example, a sand mill, a homogenizer, a ball mill, a paint shaker, an ultrasonic disperser, a stirrer using a typical stirring blade, a magnetic stirrer, and a high-speed disperser may be used for the stirring and mixing.

—Ink Properties—

Ink properties are not particularly limited and can be appropriately selected according to the intended purpose. For example, the viscosity is preferably 2 mPa·s or more at 25° C., more preferably 3 mPa·s or more but 20 mPa·s or less at 25° C. from the viewpoints of image qualities, such as the qualities of characters recorded on print media. When the viscosity is 2 mPa·s or more, the discharge stability can be enhanced.

Ink Cartridge

Examples of a container to accommodate the ink include, but not limited to, an ink cartridge. Examples of the ink cartridge include ink cartridges to accommodate process color ink, special color ink, and white ink (ink for at least one of foundation and background) in containers. The ink cartridge includes a container and the ink stored in the container, and further includes other members appropriately selected if necessary.

The shape, structure, size, and material of the container are not particularly limited and can be appropriately selected according to the intended purpose. Examples of the container include containers including at least an ink bag formed of, for example, an aluminum lamination film or a resin film.

Recorded Product

The recorded product includes an image recorded on a recording medium with ink.

<Recording Medium>

A recording medium (print medium) is not particularly limited. Examples of the recording medium include plain paper, gloss paper, special paper, and cloth. However, a favorable image can be formed even on an impermeable medium. The impermeable medium is a substrate having a surface with low moisture permeability and absorbency and includes a material having myriad of hollow spaces inside but not open to the outside. To be more quantitative, the substrate has a water-absorption amount of 10 $mL/m^2$ or less between the contact and 30 $msec^{1/2}$ after the contact according to Bristow method. For example, plastic films of polyvinyl chloride resin, polyethylene terephthalate (PET), polypropylene, polyethylene, and polycarbonate can be suitably used for the impermeable medium. Examples of the recording medium are not limited to typically-used recording media. For example, construction materials, such as wall paper, floor materials, and tiles, cloths for clothing, such as T-shirts, textile, and leather can be suitably used as the recording medium. In addition, for example, ceramics, glass, and metal can be used by adjusting the configuration of a path to convey the recording medium.

EXAMPLES

Further understanding of the present disclosure can be obtained by reference to certain specific examples provided herein below for the purpose of illustration only and are not intended to be limiting.

Preparation Example 1 of Pigment Dispersion Liquid

Preparation of Black Pigment Dispersion Liquid

After a mixture according to the following prescription was premixed, the mixture was circulated and dispersed for seven hours in a disc-type bead mill (KDL model, manufactured by Shinmaru Enterprises Corporation, media: zirconia ball having a diameter of 0.3 mm). Thus, a black pigment dispersion liquid (pigment solid content concentration: 20% by mass) was obtained.

Carbon black pigment (product name: Monarch 800, manufactured by Cabot Corporation) . . . 15 parts by mass Anionic surfactant (PIONINE A-51-B manufactured by TAKEMOTO OIL & FAT Co., Ltd.) . . . 2 parts by mass Deionized water . . . 83 parts by mass

Preparation Example 2 of Pigment Dispersion Liquid

Preparation of Cyan Pigment Dispersion Liquid

A cyan pigment dispersion liquid (pigment solid content concentration: 20% by mass) was prepared similarly with the Preparation Example 1 of the pigment dispersion liquid except that the carbon black pigment was changed to pigment blue 15:3 (product name: LIONOL BLUE FG-7351 manufactured by TOYO INK CO., LTD.).

Preparation Example 3 of Pigment Dispersion Liquid

Preparation of Magenta Pigment Dispersion Liquid

A magenta pigment dispersion liquid (pigment solid content concentration: 20% by mass) was prepared similarly with the Preparation Example 1 of the pigment dispersion liquid except that the carbon black pigment was changed to pigment red 122 (product name: Toner Magenta EO02 manufactured by Clariant Japan Co., Ltd).

Preparation Example 4 of Pigment Dispersion Liquid

Preparation of Yellow Pigment Dispersion Liquid

A yellow pigment dispersion liquid (pigment solid content concentration: 20% by mass) was prepared similarly with the Preparation Example 1 of the pigment dispersion liquid except that the carbon black pigment was changed to pigment yellow 74 (product name: First Yellow 531 manufactured by Dainichiseika Color & Chemicals Mfg. Co., Ltd.).

Preparation Example 5 of Pigment Dispersion Liquid

Preparation of White Pigment Dispersion Liquid

A white pigment dispersion liquid (pigment solid content concentration: 25% by mass) was obtained by mixing 25 parts by mass of titanium oxide (product name: STR-100W manufactured by SAKAI CHEMICAL INDUSTRY CO., LTD.), 5 parts by mass of pigment dispersant (product name: TEGO® Dispers 651 manufactured by Evonik Industries AG), and 70 parts by mass of water, and dispersing zirconia beeds having a diameter of 0.3 mm at a filling factor of 60% at a speed of 8 m/s for five minutes by a bead mill (product name: Research Lab manufactured by Shinmaru Enterprises Corporation).

Preparation Example 1 of Resin Particles

Preparation of Polycarbonate-Based Urethane Resin Emulsion

A reaction vessel equipped with a stirrer, a reflux condenser, and a thermometer was charged with 1,500 g of polycarbonate diol (i.e., a reaction product (number average molecular weight (Mn): 1,200) of 1,6-hexanediol and dimethyl carbonate), 220 g of 2,2-dimethylol propionic acid (hereinafter also referred to as DMPA), and 1,347 g of N-methylpyrrolidone (hereinafter also referred to as NMP) under nitrogen airflow. The vessel was heated to 60° C. to dissolve DMPA. Further, 1,445 g of 4,4'-dicyclohexylmethane diisocyanate and 2.6 g of dibutyltin dilaurate (serving as a catalyst) were added to the vessel. The vessel was heated to 90° C. and the vessel contents were subjected to an urethane-forming reaction for 5 hours. Thus, an isocyanate-terminal urethane prepolymer was prepared. The reaction mixture was cooled to 80° C. and further mixed with 149 g of triethylamine. The resulting mixture in an amount of 4,340 g was added to a mixture liquid of 5,400 g of water and 15 g of triethylamine while strongly stirring the mixture liquid. Next, 1,500 g of ice was poured in the mixture liquid, and then 626 g of a 35% by mass aqueous solution of 2-methyl-1,5-pentanediamine was added thereto to cause a chain extension reaction. The solvent was distilled away so that the solid content concentration became 30% by mass. Thus, a polycarbonate-based urethane resin emulsion was prepared. Using the polycarbonate-based urethane resin emulsion, the minimum filming temperature was measured with the film-forming temperature tester (of the product name 1530 manufactured by IMOTO MACHINERY CO LTD.). The minimum film forming temperature was 55° C.

Preparation Example 2 of Resin Particles

Preparation of Polyether-Based Urethane Resin Emulsion

In a nitrogen-substituted reaction vessel equipped with a thermometer, a nitrogen gas inlet tube, and a stirrer, a reaction was made using 100.2 parts by mass of polyether polyol (a product name of PTMG1000 manufactured by Mitsubishi Chemical Corporation, the mean molecular weight of 1,000), 15.7 parts by mass of 2,2-dimethylol propionic acid, 48.0 parts by mass of isophorone diisocyanate, 77.1 parts by mass of methyl ethyl ketone as organic solvent, and 0.06 parts by mass of dibutyltin dilaurate (hereinafter also referred to as DMTDL) as catalyst. After the reaction was continued for 4 hours, 30.7 parts by mass of methyl ethyl ketone was supplied as a diluting solvent and the reaction was further continued. When the mean molecular weight of the reaction product reaches a range of 20,000 or more but 60,000 or less, 1.4 parts by mass of methanol was poured into the vessel to stop the reaction. Thus, an organic solvent solution of urethane resin was prepared. To the organic solvent solution of the urethane resin, 13.4 parts by mass of potassium hydroxide solution of 48% by mass were added to neutralize a carboxyl group. Then, after 715.3 parts by mass of water were added to the solution and fully stirred, aging and the removal of the solvent were performed on the solution. Thus, a polyether-based urethane resin emulsion having a solid content of 30% by mass was obtained. On the polyether-based urethane resin emulsion, the minimum film-forming temperature was measured with the film-forming temperature tester, similarly with the Preparation Example 1 of the polycarbonate-based urethane resin emulsion. The minimum film forming temperature was 43° C.

Preparation Example 3 of Resin Particles

Preparation of Polyester-Based Urethane Resin Emulsion

A polyester-based urethane resin having a solid content of 30% by mass was prepared similarly with the above-described Preparation Example 2 of Resin Particle (polyether-based urethane resin emulsion) except that the polyether polyol (product name: PTMG1000 manufactured by Mitsubishi Chemical Corporation, mean molecular weight: 1,000) was changed to polyester polyol (product name: Polylite OD-X-2251 manufactured by DIC Corporation, mean molecular weight: 2,000). On the polyester-based urethane resin emulsion, the minimum film-forming temperature was measured with the film-forming temperature tester (model name: 1530 manufactured by IMOTO MACHINERY CO., LTD.), similarly with the preparation of the polycarbonate-based urethane resin emulsion. The minimum film forming temperature was 74° C.

Preparation Example 4 of Resin Particles

Preparation of Acrylic Resin Emulsion

A reaction vessel equipped with a stirrer, a reflux condenser, a dropping device, and a thermometer was charged with 900 g of deionized water and 1 g of sodium lauryl sulfate. The vessel was heated to 70° C. while performing nitrogen substitution under stirring. The internal temperature was held at 70° C. After 4 g of potassium persulfate was added as a polymerization initiator and dissolved, an emulsion prepared in advance by adding 20 g of acrylamide, 615 g of styrene, 30 g of butyl acrylate, and 350 g of methacrylic acid to 450 g of deionized water and 3 g of sodium lauryl sulfate under stirring was continuously dropped into a reaction solution for 4 hours. After completion of the dropping, the mixture was matured for 3 hours to obtain aqueous emulsion. After the obtained aqueous emulsion was cooled to room temperature, deionized water and sodium hydroxide aqueous solution were added to obtain an acrylic resin emulsion having a solid content concentration of 30% by mass and pH 8. On the acrylic resin emulsion, the minimum film-forming temperature was measured with the film-forming temperature tester (model name: 1530 manufactured by IMOTO MACHINERY CO., LTD.), similarly with the above-described Preparation Example 1 of the polycarbonate-based urethane resin emulsion. The minimum film forming temperature was 53° C.

<Preparation of Ink 1>

Ink 1 was prepared by mixing and stirring 20% by mass of black pigment dispersion liquid, 10% by mass (in terms of the resin solid content) of polycarbonate-based urethane resin emulsion (solid content concentration: 30% by mass), 12% by mass of 1,2-propanediol, 5% by mass of 1,2-butanediol, 17% by mass of 3-methoxy-N, N-dimethyl propionamide (product name: ECUAMIDE M-100 manufactured by Idemitsu Kosan Co., Ltd.), 1% by mass of siloxane compound (product name: FZ-2110 manufactured by Dow Corning Toray Co., Ltd., HLB=1.0), 0.1% by mass of preservative (product name: Proxel™ LV manufactured by Avecia Inc.), and 12% by mass of high purity water, and filtering the mixture by a 0.2 μm polypropylene filter (manufactured by Nihon Pall Ltd.).

<Preparation of Inks 2 to 6>

Inks 2 to 6 are prepared similarly with the ink 1 except that the composition and amount of the ink 1 are changed to the composition and amount described in Table 1.

TABLE 1

| | | Ink Composition | | | | | |
|---|---|---|---|---|---|---|---|
| Ink No. | | 1 | 2 | 3 | 4 | 5 | 6 |
| Pigment | Black pigment dispersion | 20 | — | — | — | 20 | — |
| | Cyan pigment dispersion | — | 20 | — | — | — | — |
| | Magenta pigment dispersion | — | — | 20 | — | — | — |
| | Yellow pigment dispersion | — | — | — | 20 | — | — |
| | White pigment dispersion | — | — | — | — | — | 15 |
| Resin particles | Polycarbonate-based urethane resin emulsion | 10 | — | — | — | — | 5 |
| | Polyether-based urethane resin emulsion | — | — | — | 10 | — | — |
| | Polyester-based urethane resin emulsion | — | — | 7 | — | 9 | — |
| | Acrylic resin emulsion | — | 8 | — | — | — | — |

TABLE 1-continued

| Ink No. | | | Ink Composition 1 | 2 | 3 | 4 | 5 | 6 |
|---|---|---|---|---|---|---|---|---|
| Organic solvent | Compound represented by General Formula (1) | 3-methoxy-N,N-dimethyl propionamide | 17 | 16 | — | 16 | — | — |
| | | 3-butoxy-N,N-dimethyl propionamide | — | — | 14 | — | — | 6 |
| | 1,2-propanediol | | 12 | 20 | 20 | 15 | 20 | 20 |
| | 1,2-butanediol | | 5 | — | 2 | — | 10 | — |
| Siloxane compound | Polyether-modified silicone | | 1 | 1 | 1 | 0.8 | 1.2 | 1 |
| Common components | Proxel ™ LV | | 0.1 | 0.1 | 0.1 | 0.1 | 0.1 | 0.1 |
| | High pure water | | Rest | Rest | Rest | Rest | Rest | Rest |
| Total (percent by mass) | | | 100 | 100 | 100 | 100 | 100 | 100 |

Note that the product names and the manufacturer names of components used in the above-described examples are as follows:

Carbon black pigment (product name: Monarch 800, manufactured by Cabot Corporation)

Pigment blue 15:3 (product name: LIONOL BLUE FG-7351 manufactured by TOYO INK CO., LTD.)

Anionic surfactant (PIONINE A-51-B manufactured by TAKEMOTO OIL & FAT Co., Ltd.)

Pigment red 122 (product name: Toner Magenta EO02 manufactured by Clariant Japan Co., Ltd.)

Pigment yellow 74 (product name: First Yellow 531 manufactured by Dainichiseika Color & Chemicals Mfg. Co., Ltd.)

Titanium oxide (product name: STR-100W manufactured by SAKAI CHEMICAL INDUSTRY CO., LTD.)

Pigment dispersant (product name: TEGO® Dispers 651 manufactured by Evonik Industries AG)

Polyether polyol (product name: PTMG1000 manufactured by Mitsubishi Chemical Corporation, mean molecular weight: 1,000)

Polyester polyol (product name: Polylite OD-X-2251 manufactured by DIC Corporation, mean molecular weight: 2,000)

3-methoxy-N, N-dimethyl propionamide (product name: ECUAMIDE M-100 manufactured by Idemitsu Kosan Co., Ltd.)

Siloxane compound (product name: FZ-2110 manufactured by Dow Corning Toray Co., Ltd., HLB=1.0)

Preservative (product name: Proxel™ LV manufactured by Avecia Inc.)

Example 1

Prepared inks were filled to the printing apparatus according to an embodiment of the present disclosure in a set of combinations described in Table 2 below. After a foundation is formed with the ink 6 (white ink) onto a recording medium of a polyvinyl chloride film (product name: CPPVWP 1300 manufactured by SAKURAI CO., LTD.), white preceding-printing (the first embodiment) was performed to record a diagonal pattern image and a solid image illustrated in FIGS. 18 and 19 with the inks 1 and 2.

Examples 2 to 9 and 12

Examples 2 to 9 and 12 were performed similarly with Example 1 except that the composition and amount of Example 1 were changed to the composition and amount described in Table 2. A commercial RICOH Pro Ink (product name: RICOH Pro AR Ink manufactured by RICOH CO., Ltd.) was used as ink in Example 12

Example 10

Figure 18:
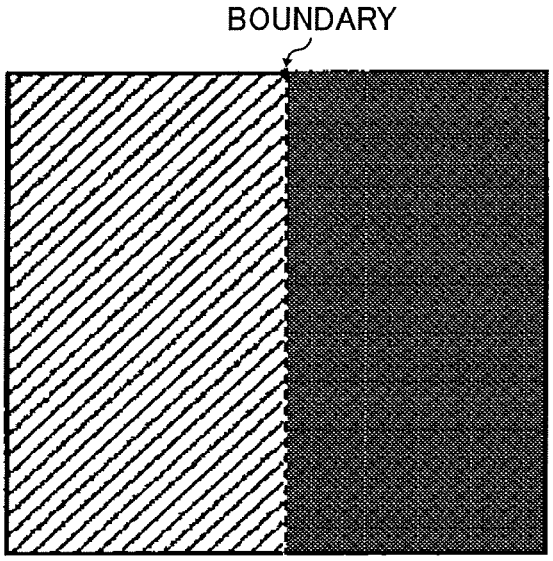
FIG. 18 is a plan view of an example of a result of a print image printed by the printing apparatus according to an embodiment of the present disclosure.
Figure 19:
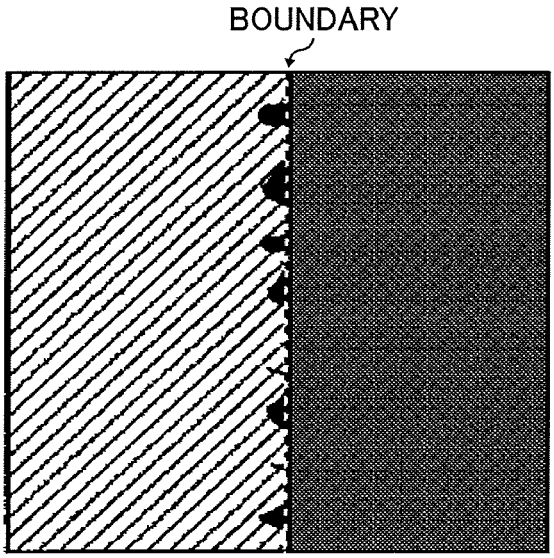
FIG. 19 is a plan view of an example of another result of a print image printed by the printing apparatus according to an embodiment of the present disclosure.

Example 10 was performed similarly with Example 1, except that white succeeding-printing (the fifth embodiment) to form a white ink layer with the ink 6 was performed after the diagonal pattern image and the solid image illustrated in FIGS. 18 and 19 were formed with the ink 1 and the ink 3.

Example 11

Example 11 was performed similarly with Example 1, except that three-layer printing (the sixth embodiment) was performed. In the three-layer printing, white succeeding-printing (the fifth embodiment) to form a white ink layer with the ink 6 was performed after the diagonal pattern image and the solid image illustrated in FIGS. 18 and 19 were formed with the ink 1 and the ink 3, and then the diagonal pattern image and the solid image illustrated in FIGS. 18 and 19 were further formed on the white ink layer with the ink 1 and the ink 3.

Next, the presence or absence of bleeding was evaluated in the following manner. Evaluation results are presented in Table 2.

<Presence or Absence of Bleeding>

The presence or absence of bleeding in a square boundary between the diagonal pattern image and the solid image formed on the polyvinyl chloride film was visually checked, and "the presence or absence of bleeding" was evaluated based on the following evaluation standard. Note that the evaluation results of "fair", "good", and "very good" indicate non-problematic levels in use.

Evaluation Standard

Very good: all square boundaries of images formed at a productivity of 50 $m^2$/h are free of bleeding as illustrated in FIGS. 18 and 19 Good: all square boundaries of images formed at a productivity of 45 $m^2$/h are free of bleeding as illustrated in FIGS. 18 and 19 Fair: all square boundaries of images formed at a productivity of 40 $m^2$/h are free of bleeding as illustrated in FIGS. 18 and 19

TABLE 2

| | Embodiment | Second liquid Foundation and background ink (white) | First liquid Color ink Diagonal pattern image | First liquid Color ink Solid image | Bleeding Evaluation result |
|---|---|---|---|---|---|
| Example 1 | 1 | 6 | 1 | 2 | Good |
| Example 2 | 1 | 6 | 1 | 3 | Very good |
| Example 3 | 1 | 6 | 1 | 4 | Very good |
| Example 4 | 1 | 6 | 5 | 2 | Good |
| Example 5 | 1 | 6 | 5 | 3 | Very good |
| Example 6 | 1 | 6 | 5 | 4 | Very good |
| Example 7 | 1 | 6 | 2 | 3 | Good |
| Example 8 | 1 | 6 | 3 | 4 | Good |
| Example 9 | 1 | 6 | 2 | 4 | Good |
| Example 10 | 5 | 6 | 1 | 3 | Very good |
| Example 11 | 6 | 6 | 1 | 3 | Very good |
| Example 12 | 1 | Commercial product (white) | Commercial product (cyan) | Commercial product (magenta) | Fair |

From the results of Examples 1 to 12, it was found that the printing apparatus according to an embodiment of the present disclosure could record images of high print qualities while preventing a decrease in print speed. By using ink containing water, organic solvent, pigment, resin particles, and siloxane compound, a white ink of high drying performance was obtained. Forming a background with the white ink increased the smoothness of an ink layer forming a color ink in bidirectional printing, and a glossy image was obtained. In other words, it was found that, as illustrated in FIGS. 18 and 19, a high quality image could be recorded while reducing bleeding. In particular, it was found that using polycarbonate-based polyurethane resin as resin particles were effective to reduce bleeding.

Aspects of the present disclosure are, for example, as follow.

Aspect 1

A printing apparatus includes a liquid discharge device, a carriage, and a controller. The liquid discharge device includes a first nozzle row to discharge a first liquid to form an image and a second nozzle row to discharge a second liquid of a type different from the first liquid. The carriage is mounted with the liquid discharge device and reciprocally movable in a main scanning direction. The controller controls the liquid discharge device to discharge the second liquid onto a region of a medium including another region onto which the first liquid is discharged. The controller includes a control unit to control the liquid discharge device to discharge the second liquid from the second nozzle row in both directions of a forward path and a backward path of the carriage and discharge the first liquid from the first nozzle row in one direction of the forward path and the backward path of the carriage.

Aspect 2

In the printing apparatus according to aspect 1, the length of the second nozzle row is shorter than the length of the first nozzle row.

Aspect 3

In the printing apparatus according to aspect 2, the length of the second nozzle row is half of the length of the first nozzle row.

Aspect 4

In the printing apparatus according to any one of aspects 1 to 3, the second nozzle row is disposed away from the first nozzle row in a sub-scanning direction perpendicular to the main scanning direction.

Aspect 5

In the printing apparatus according to any one of aspects 1 to 4, the second liquid is a background liquid to form a background.

Aspect 6

In the printing apparatus according to any one of aspects 1 to 5, each of the first liquid and the second liquid contains water, an organic solvent, a colorant, resin particles, and a siloxane compound.

Aspect 7

In the printing apparatus according to aspect 6, the resin particles are of urethane resin.

Aspect 8

In the printing apparatus according to aspect 7, the urethane resin is at least one selected from a polycarbonate-based urethane resin and a polyester-based urethane resin.

Aspect 9

In the printing apparatus according to any one of aspects 6 to 8, the organic solvent contains a compound represented by the following General Formula (1):

Chemical Formula 4

GENERAL FORMULA (1)

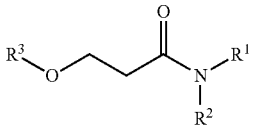

where, in the above-described General Formula (1), $R^1$, $R^2$, and $R^3$ each represent an alkyl group having 1 or more but 5 or less carbon atoms, and $R^1$, $R^2$, and $R^3$ may be identical to or different from each other.

Aspect 10

In the printing apparatus according to any one of aspects 6 to 9, the organic solvent contains 3-methoxy-N, N-dimethyl propionamide represented by the following Structural Formula (1-1):

Chemical Formula 5

STRUCTURAL FORMULA (1-1)

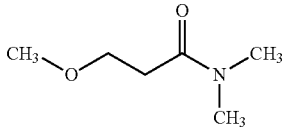

Aspect 11

In the printing apparatus according to any one of aspects 6 to 10, the organic solvent contains 3-butoxy-N, N-dimethyl propionamide represented by the following Structural Formula (1-2):

Chemical Formula 6

STRUCTURAL FORMULA (1-2)

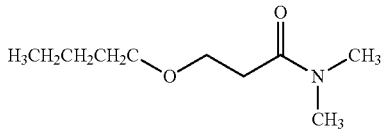

Aspect 12

In the printing apparatus according to any one of aspects 6 to 11, the organic solvent contains 3-methoxy-N, N-diethyl propionamide.

Aspect 13

In the printing apparatus according to any one of aspects 6 to 12, the colorant is at least one selected from a white colorant and an image forming colorant.

Aspect 14

In the printing apparatus according to aspect 13, the white colorant is at least one selected from the group of titanium oxide, iron oxide, tin oxide, zirconium oxide, and iron titanate.

Aspect 15

In the printing apparatus according to any one of aspects 13 and 14, the image forming colorant is at least one selected from the group of a color ink, a special color ink, a black ink, a gray ink, a clear ink, a metallic ink, and a non-white ink.

Aspect 16

In the printing apparatus according to any one of aspects 13 to 15, the image forming colorant is at least one selected from the group of an inorganic pigment and an organic pigment.

Aspect 17

In the printing apparatus according to aspect 16, the inorganic pigment is at least one selected from the group of titanium oxide, iron oxide, calcium carbonate, barium sulfate, aluminum hydroxide, barium yellow, cadmium red, and chrome yellow.

Aspect 18

In the printing apparatus according to any one of aspects 1 to 17, the liquid discharge device includes at least one liquid discharge head including a plurality of nozzle rows.

Aspect 19

A program according to an embodiment of the present disclosure causes a computer to perform control to discharge a second liquid onto a region of a medium including another region on which a first liquid is discharged in an image forming apparatus. The image forming apparatus includes a liquid discharge device and a carriage. The liquid discharge device includes a first nozzle row to discharge the first liquid to form an image and a second nozzle row to discharge the second liquid of a type different from the first liquid. The carriage is mounted with the liquid discharge device and reciprocally movable in a main scanning direction. The program causes the computer to perform control to discharge the second liquid from the second nozzle row in both directions of a forward path and a backward path of the carriage and discharge the first liquid from the first nozzle row in one direction of the forward path and the backward path of the carriage.

Aspect 20

In a method of printing with the printing apparatus according to any one of aspects 1 to 18, ink containing water, a pigment, a siloxane compound, a compound of the following General Formula (1), and at least one resin of a polycarbonate-based urethane resin and a polyester-based urethane resin is used as the first liquid and the second liquid.

Chemical Formula 7

GENERAL FORMULA (1)

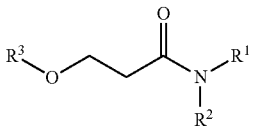

where, in the above-described General Formula (1), $R^1$, $R^2$, and $R^3$ each represent an alkyl group having 1 or more but 5 or less carbon atoms, and $R^1$, $R^2$, and $R^3$ may be identical to or different from each other.

According to at least one of the printing apparatus according to any one of aspects 1 to 18, the program according to aspect 19, and the printing method according to aspect 20, print qualities can be enhanced while reducing a decrease in print speed.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A printing apparatus comprising:

a liquid discharge device including:

a first nozzle row to discharge a first liquid to form an image; and a second nozzle row to discharge a second liquid of a type different from the first liquid;

a carriage mounted with the liquid discharge device and reciprocally movable in a main scanning direction; and a controller configured to control the liquid discharge device to discharge the second liquid onto a region of a medium including another region onto which the first liquid is discharged, the controller including a control unit to control the liquid discharge device to discharge the second liquid from the second nozzle row in both of forward movement and backward movement of the carriage and discharge the first liquid from the first nozzle row in one of the forward movement and the backward movement of the carriage.

2. The printing apparatus according to claim 1, wherein a length of the second nozzle row is shorter than a length of the first nozzle row.

3. The printing apparatus according to claim 2, wherein the length of the second nozzle row is half of the length of the first nozzle row.

4. The printing apparatus according to claim 1, wherein the second nozzle row is disposed away from the first nozzle row in a sub-scanning direction perpendicular to the main scanning direction.

5. The printing apparatus according to claim 1, wherein the second liquid is a background liquid to form a background.

6. The printing apparatus according to claim 1, wherein each of the first liquid and the second liquid comprises water, an organic solvent, a colorant, resin particles, and a siloxane compound.

7. The printing apparatus according to claim 6, wherein the resin particles are of urethane resin.

8. The printing apparatus according to claim 7, wherein the urethane resin is at least one selected from a polycarbonate-based urethane resin and a polyester-based urethane resin.

9. The printing apparatus according claim 6, wherein the organic solvent comprises a compound represented by a general formula (1) below:

GENERAL FORMULA (1)

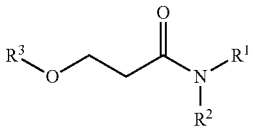

where, in the general formula (1), each of $R^1$, $R^2$, and $R^3$ represents an alkyl group having 1 or more but 5 or less carbon atoms, and $R^1$, $R^2$, and $R^3$ are identical to or different from each other.

10. The printing apparatus according to claim 1, wherein the liquid discharge device includes at least one liquid discharge head including a plurality of nozzle rows.

11. A non-transitory recording medium storing a computer-readable program to cause a computer to perform a method of controlling an image forming apparatus, the method comprising:

controlling a liquid discharge device of the image forming apparatus to discharge a second liquid onto a region of a medium including another region on which a first liquid is discharged; and controlling the liquid discharge device to discharge the second liquid from a second nozzle row of the liquid discharge device in both of forward movement and backward movement of a carriage of the image forming apparatus and discharge the first liquid from a first nozzle row of the liquid discharge device in one of the forward movement and the backward movement of the carriage.

12. A method of printing with a printing apparatus, the method comprising:

controlling a liquid discharge device of the printing apparatus to discharge a second liquid onto a region of a medium including another region on which a first liquid is discharged; and controlling the liquid discharge device to discharge the second liquid from a second nozzle row of the liquid discharge device in both of forward movement and backward movement of a carriage of the printing apparatus and discharge the first liquid from a first nozzle row of the liquid discharge device in one of the forward movement and the backward movement of the carriage.

13. The method according to claim 12, wherein each of the first liquid and the second liquid is ink comprising water, a pigment, a siloxane compound, a compound represented by a general formula (1) below, and at least one resin of a polycarbonate-based urethane resin and a polyester-based urethane resin,

GENERAL FORMULA (1)

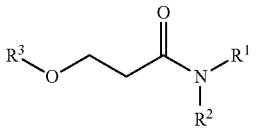

where, in the general formula (1), each of $R^1$, $R^2$, and $R^3$ represents an alkyl group having 1 or more but 5 or less carbon atoms, and $R^1$, $R^2$, and $R^3$ are identical to or different from each other.

* * * * *